US009112323B2

(12) United States Patent
Goebel et al.

(10) Patent No.: US 9,112,323 B2
(45) Date of Patent: Aug. 18, 2015

(54) SHIELDED AND MULTISHIELDED COAXIAL CONNECTORS

(71) Applicant: Holland Electronics LLC, Ventura, CA (US)

(72) Inventors: George Goebel, Camarillo, CA (US); Reed Gibson, Ventura, CA (US); Michael Holland, Santa Barbara, CA (US)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 14/494,488

(22) Filed: Sep. 23, 2014

(65) Prior Publication Data

US 2015/0011120 A1 Jan. 8, 2015

Related U.S. Application Data

(63) Continuation-in-part of application No. 13/489,406, filed on Jun. 5, 2012, now Pat. No. 8,777,658, and a continuation-in-part of application No. 13/723,800, filed on Dec. 21, 2012, now Pat. No. 9,048,600, which is a continuation-in-part of application No. 14/069,221, filed on Oct. 31, 2013, which is a continuation-in-part of application No. 13/712,828, filed on Dec. 12, 2012.

(60) Provisional application No. 61/612,922, filed on Mar. 19, 2012, provisional application No. 61/620,355, filed on Apr. 4, 2012, provisional application No. 61/969,204, filed on Mar. 23, 2014, provisional application No. 62/039,169, filed on Aug. 19, 2014.

(51) Int. Cl.

| | |
|---|---|
| ***H01R 9/05*** | (2006.01) |
| ***H01R 24/46*** | (2011.01) |
| ***H01R 4/48*** | (2006.01) |
| *H01R 24/52* | (2011.01) |

(52) U.S. Cl.
CPC ..... *H01R 24/46* (2013.01); *H01R 4/48* (2013.01); *H01R 24/525* (2013.01)

(58) Field of Classification Search
CPC ..... H01R 24/40; H01R 24/525; H01R 24/46; H01R 13/7036
USPC ..... 439/578
See application file for complete search history.

(56) References Cited

U.S. PATENT DOCUMENTS

| | | | | |
|---|---|---|---|---|
| 4,275,946 | A | 6/1981 | Manina et al. | |
| 4,941,846 | A * | 7/1990 | Guimond et al. | 439/578 |

(Continued)

FOREIGN PATENT DOCUMENTS

| | | | |
|---|---|---|---|
| JP | 08-168015 | A | 6/1996 |
| JP | 2010-118201 | A | 5/2010 |

OTHER PUBLICATIONS

Society of Cable Telecommunications Engineers; Engineering Committee Interface Practices Subcommittee; American National Standard; ANSI/SCTE 74 2011.

*Primary Examiner* — Jean F Duverne
(74) *Attorney, Agent, or Firm* — Paul D. Chancellor; Ocean Law

(57) ABSTRACT

A shielded coaxial connector with a moveable center conductor and a stationary center conductor, the center conductors forming a disconnect switch that interoperates with a waveguide to shield one of the center conductors from radio frequency signals such as radio frequency signals carried by the other center conductor.

18 Claims, 22 Drawing Sheets

(56) References Cited

U.S. PATENT DOCUMENTS

| | | | | |
|---|---|---|---|---|
| 5,280,254 | A * | 1/1994 | Hunter et al. | 333/124 |
| 5,632,637 | A | 5/1997 | Diener | |
| 5,775,927 | A * | 7/1998 | Wider | 439/188 |
| 5,921,793 | A | 7/1999 | Phillips | |
| 6,106,314 | A | 8/2000 | McLean et al. | |
| 6,921,283 | B2 * | 7/2005 | Zahlit et al. | 439/489 |
| 7,416,444 | B1 * | 8/2008 | Lin | 439/578 |
| 8,419,468 | B2 * | 4/2013 | Alrutz et al. | 439/578 |
| 2004/0214462 | A1 | 10/2004 | Huang | |
| 2005/0148236 | A1 | 7/2005 | Montena | |
| 2006/0252306 | A1 | 11/2006 | Montena | |
| 2007/0298653 | A1 | 12/2007 | Mahoney et al. | |
| 2009/0011628 | A1 | 1/2009 | Purchon | |
| 2009/0114424 | A1 | 5/2009 | Holland | |
| 2010/0221940 | A1 * | 9/2010 | Hoyack et al. | 439/188 |
| 2010/0255721 | A1 | 10/2010 | Purdy et al. | |
| 2011/0117776 | A1 | 5/2011 | Burris et al. | |
| 2011/0244720 | A1 | 10/2011 | Peng | |
| 2014/0024234 | A1 | 1/2014 | Holland | |

* cited by examiner

SHIELDED AND MULTISHIELDED COAXIAL CONNECTORS

PRIORITY CLAIM AND INCORPORATION BY REFERENCE

This application is a continuation-in-part of U.S. patent application Ser. No. 13/489,406 filed Jun. 5, 2012 (now U.S. Pat. No. 8,777,658 issued Jul. 15, 2014) and Ser. No. 13/723,800 filed Dec. 21, 2012, both of which claim the benefit of U.S. Prov. App. No. 61/612,922 filed Mar. 19, 2012. This application is a continuation-in-part of U.S. patent application Ser. No. 14/069,221 filed Oct. 31, 2013 which is a continuation-in-part of U.S. patent application Ser. No. 13/712,828 filed Dec. 12, 2012 which claims the benefit of U.S. Prov. Pat. App. No. 61/620,355 filed Apr. 4, 2012. This application claims the benefit of U.S. Prov. App. No. 61/969,204 filed Mar. 23, 2014 and 62/039,169 filed Aug. 19, 2014. All of the aforementioned applications are incorporated by reference herein, in their entireties and for all purposes.

BACKGROUND OF THE INVENTION

1. Field of the Invention

The invention relates to the field of manufactured radio frequency devices. More particularly, the present invention relates to radio frequency shields for use in association with a coaxial connector.

2. Discussion of the Related Art

FIGS. 1-4D show prior art devices. Prior art CATV signal outlets are shown in FIGS. 1, 2, and 4B while prior art coaxial cable connectors are shown in FIGS. 3A-B, 4A, 4C, and 4D.

FIG. 1 shows a front view of a wall mounted coaxial connector 100. The connector 102 is mounted on a wall plate 104 fixed to a room wall 106. As shown, the connector is a female F connector. A hole 108 in an insulator 110 of the connector 102 provides access to a CATV signal conductor 304 (see FIGS. 3A-B) within the connector.

FIG. 2 shows a side view of the wall mounted coaxial connector 200 of FIG. 1. Here, the female F connector 102 is shown as a female-female connector for splicing coaxial cable. Threads at opposed ends of the connector 203, 205 provide a means for attaching male F connectors to opposed splice ends 207, 209. A coaxial cable for carrying a CATV signal 204 is terminated with a male F connector 202 that threadingly engages an end 209 of the splice.

Typical coaxial cable features will be known to persons of ordinary skill in the art. For example, an embodiment includes a center conductor 220 surrounded by a dielectric material 222, the dielectric material being surrounded in turn by one or two shields 224 such as a metallic foil wrapped in a metallic braid. An outer insulative jacket 226 such as a polyvinylchloride jacket encloses the conductors.

As seen, the open end of the splice 207 provides an opportunity for unwanted RF ingress 208. In particular, unwanted RF ingress 206 is shown entering an exposed end of the splice 207 where it is conducted by a CATV signal conductor 204 through the connector and to a signal conductor 220 of the attached CATV coaxial cable.

FIG. 3A shows a cross-section of a splice 300A and FIG. 3B shows a side view of the splice of same splice 300B. Referring to both of the figures, the splice includes a cylindrical outer body 302 with a circumferential, hexagonal grip 304 between opposed first and second ends 322, 324 of the splice. Outer surfaces of the body are threaded, in particular, an outer surface between the first end and the grip ring is threaded 309 and an outer surface between the second end and the grip ring is threaded 311.

Within and at opposed ends of the cylindrical body 304 are insulators 306, 308, each having a central cavity 310, 312 for receiving opposed ends 316, 318 of a tubular seizing pin 394. Resilient tines located in each end of the seizing pin 370, 372 provide a means for making a secure electrical contact with a conductor (not shown) inserted in either end of the seizing pin. Splice internals are typically fixed in place by rolling an end of the body 324. In some embodiments, rolling a body end 324 or an interference fit fixes an annular plug 323 adjacent to the second end insulator 312.

FIG. 4A shows a cross-sectional view of a bulkhead port connector 400A. To the extent that connector internals are insertable from only a single end, the connector may be referred to as "blind." The connector provides an F female connection such as a threaded port 414 at one end and a mount 403 at an opposed end. The connector includes an electrically conductive body 402, and an internal contact 407 with a trailing portion or terminal 401 electrically interconnected by a link 404. The contact is supported by an insulator 408, 412 that is held in place by a port end lip 405. An aperture 418 in the insulator provides for inserting a coaxial cable center conductor into the port contact 407 and body threads 414 provide for engaging an F male connector having a threaded nut.

The bulkhead port 400A has a mount 403 at one end that may be separate from or include portions of a device/equipment bulkhead or portion(s) thereof. The mount supports the bulkhead port at a base 417. A contact trailing portion 401 passes through a hole in a base insulator 406 and then through a passageway in the base. An airgap and/or insulator may be used to electrically isolate the contact trailing portion from electrically conductive mount.

FIG. 4B shows a coaxial cable drop within a room 400B. As shown, a hole 434 penetrates a room baseboard 432 and a length of coaxial cable 439 enters the room through the hole. Such cable drops are typically terminated with male F connectors. In particular, a male F connector 436 has an outer shell 435 adjacent to a fastener 433 and a prepared end of the coaxial cable is inserted in the connector such that the central conductor 438 of the coaxial cable protrudes beyond a fastener free end 431.

FIG. 4C shows a compression type male F connector 400C. A connector body 446 arranged concentrically about a post 449 provides an annular cavity 448 for receiving metal braid 447 and jacket 445 of a coaxial cable 450. The body and a fastener 444 are rotatably engaged. Passing through a hollow interior of the post is coaxial cable dielectric 461 and coaxial cable center conductor 442. Cable fixation occurs when a connector outer shell 443 forces a collapsible ring 441 to press against the coaxial cable jacket as the shell is slid toward a fastener 444 of the connector.

FIG. 4D shows a crimp type male F connector utilizing a fixed pin 400D. A connector body 468 is arranged concentrically about an insulator 465 and a post 466 adjacent to the insulator. The post abuts the connector body at one end 463 and is spaced apart from the connector body at an opposed end creating an annular cavity 461 for receiving metal braid and jacket of a coaxial cable (not shown). The insulator 465 supports a center conductor such as a contact pin 462 and a fastener 464 rotatably engages the body. Cable fixation occurs when a crimp zone of the connector body 470 is forced against an outer jacket of a coaxial cable (not shown).

These prior art devices may frequently be found inadequately shielded as proliferation of RF devices such as cellular telephones crowd RF spectra and increase the chances RF ingress will adversely affect interconnected systems using coaxial cable such as cable television and satellite television signal distribution systems.

Persons of ordinary skill in the art have recognized that in cable television and satellite television systems ("CATV"), reduction of interfering radio frequency ("RF") signals improves signal to noise ratio and helps to avoid saturated reverse amplifiers and related optical transmission that is a source of distortion.

Past efforts have limited some sources of the ingress of interfering RF signals into CATV systems. These efforts have included increased use of traditional connector shielding, multi-braid coaxial cables, connection tightening guidelines, increased use of traditional splitter case shielding, and high pass filters to limit low frequency spectrum interfering signal ingress in active home CATV systems.

Connectors used for home coaxial cable installations include F, IEC, MCX, and PAL type connectors. For example, in the home one will typically find a wall mounted female coaxial connector or a coaxial cable drop splitter or isolator for supplying a signal to the TV set, cable set-top box, or internet modem.

A significant location of unwanted RF signal and noise ingress into CATV systems is in the home. This occurs where the subscriber leaves a CATV connection such as a wall-mounted connector or coaxial cable drop connector disconnected/open. An open connector end exposes a normally metallically enclosed and shielded signal conductor and can be or contribute to a significant source of unwanted RF ingress.

As shown above, a CATV signal is typically supplied to a room via a wall mounted connector or in some cases a simple cable drop. These and similar cable interconnection points provide potential sources of unwanted RF signal ingress into the CATV system. As will be appreciated, multiple CATV connections in a home increase the likelihood that some connections will be left unused and open, making them a source of unwanted RF ingress. And, when subscribers move out of a home, CATV connections are typically left open, another situation that invites RF ingress in a CATV distribution system.

Known methods of eliminating unwanted RF ingress in a CATV system include adding a metal cover over each unused coaxial connector in the home or, adding a metal cover over the feeder coaxial connection at the home network box. But, the usual case is that unused home CATV connections are left active and without covers, a practice the cable television operators and the industry have accepted in lieu of making costly service calls associated with new tenants and/or providing the CATV connections in additional rooms.

The inventor's work in this area suggests current solutions for reducing unwanted RF ingress and egress resulting from open connectors are not successful and/or not widely used. Therefore, to the extent the CATV industry comes to recognize a need to further limit interfering RF ingress into CATV systems, it is desirable to have connectors that reduce RF ingress when they are left open.

Prior art exists which attempts to accomplish this goal but is frequently found to be prohibitively expensive, impractical, or unreliable. For example, U.S. Pat. No. 8,098,113 filed Oct. 9, 2009, discloses electronics that differentially cancel noise common to both the center conductor and shield and requires an electric power source. Such methods are relatively expensive compared with at least some embodiments of the present invention. They also have reliability limitations due to added electrical components such as semiconductors and/or passive devices.

SUMMARY OF THE INVENTION

The present invention provides a shield against unwanted radio frequency ("RF") signal transfer in coaxial cable installations. Shielding devices of the present invention include disconnect switches and electromagnetic radiation shields including waveguides adapted to function in conjunction with coaxial cable connectors.

Electromagnetic shields include waveguides and devices causing electric charges within a metallic shield to redistribute and thereby reduce the field's effects in a protected device interior. Further, connector interior spaces can be shielded from particular external electromagnetic radiation when suitable material(s) and connector/shield geometries are used. Notably, various embodiments shield against both of signal ingress and signal egress.

Applications include cavity openings and exposed conductors that are to be shielded from ingress, or in cases, egress, of particular RF signals or noise with appropriate shielding designs. Shields incorporating a disconnect switch may isolate a conductor otherwise exposed to unwanted RF signals. Shields incorporating a waveguide may isolate a conductor in a connector body chamber using perforated metallic structures such as plates, discs, screens, fabrics, perforated plates, and perforated discs. Waveguides may be referred to as filters tending to attenuate and/or reject passage of particular frequencies.

In the context of a coaxial cable connector, connector internal conductors or portions thereof may act as antennas to receive unwanted RF signals and/or noise via connector body openings or via exposed connectors.

Coaxial cable connectors can be shielded from unwanted RF ingress even when a coaxial cable connector end is left open, for example when a female port or connector end is left open. In various embodiments, unwanted RF ingress is restricted in a coaxial connector by, inter alia, employing disconnect switches and/or waveguides in suitable connector geometries.

Further considering coaxial connector waveguides, they are typically electrical conductors such as plates and annular structures. They may be discs and in particular generally circular discs. Waveguides may be made from fabrics such as meshes and weaves. Exemplary waveguides are made from an electrically conducting material and have opening size(s) and thickness(es) that are effective to preferentially block RF ingress such as RF ingress in a particular frequency band. Suitable waveguide materials generally include a) conductors and b) non-conductors intermingled, commixed, coated, and/or impregnated with conductors.

Incorporated by reference herein in its entirety and for all purposes are the exemplary shield technologies described in U.S. Pat. No. 7,371,977 to inventor Preonas, including in particular the shields of Preonas' FIGS. 2 and 3 and shield design considerations of Peronas' FIG. 4. As skilled artisans will recognize, analytical shield and waveguide design methods are generally available and include code incorporating Faraday's Law and finite element modeling techniques. Use of these well-known tools by skilled artisans will typically provide good approximations of shield design variables for particular specifications including waveguide aperture size, thickness, and choice of material.

Inventor experiments on some prototype waveguide designs generally showed a) increasing waveguide thickness tended to increase connector impedance and b) increasing aperture size tended to reduce RF shielding.

Embodiments of the present invention mitigate problematic RF ingress into CATV distribution systems from inadequately shielded and/or open ended coaxial cable connectors subject to unwanted RF transfer. Embodiments of the invention limit unwanted RF signal transfer into media and media distribution systems such as CATV distribution systems.

As will be appreciated, embodiments of the invention disclosed herein have application in various frequency bands and for various signal types. Embodiments provide waveguides made with suitable material(s), hole size(s), and thickness(es) for mitigating unwanted signal ingress in selected frequency bands.

Embodiments of the invention provide for waveguides with a generally annular structure and incorporating RF shielding material for shielding against undesired ingressing, or, in cases, egressing signals at frequencies in ranges below 100 MHz and at frequencies beyond 100 MHz reaching at least 2150 MHz. Waveguide aperture shapes may be circular, polygonal, curved, multiple curved, and the like. Aperture sizes include those with opening areas equivalent to circular diameters of 1.5 to 3 mm and aperture thicknesses include thicknesses in the range 0.5 to 2.0 mm. In some implementations, connectors with waveguides utilize apertures that are integral with a connector body or a disc/barrier that is within a portion of the connector such as a disk/barrier placed inside a connector body at or aft of a connector body entry but before a connector coaxial cable center conductor contact to be shielded. Suitable waveguide materials and structures include those known to skilled artisans such as metal waveguides and waveguides that incorporate surface and/or internal shielding materials including those described below.

An embodiment of the invention provides an aperture 2.0 to 3.5 mm with a nominal thickness between 0.5 to 1.5 mm. This combination of hole size and thickness acts as a waveguide restricting ingress of selected frequencies, for example frequencies below 100 MHz, by 20-40 dB (in some cases 1/100 of the signal) of that of an open-ended port such as an F port.

The combination of sizes serves to restrict the ingress while only minimally reducing the impedance of the operational connector interface. The reduced impedance match (sometimes characterized in terms of return loss) of the invention remains within limits acceptable to the CATV industry. As the aperture size grows beyond 3.5 mm, there is typically less shielding against unwanted signals a CATV connector entry.

Restriction of radio frequency ("RF") signal ingress may be for particular frequency ranges such as restricting frequencies in the range of kilohertz to gigahertz. For example, restricting ingress of signals interfering with CATV including cable and satellite television equipment may require restricting signals in the frequency range of about 1 MHz to 1000 MHz.

Because ingress restriction devices may change a coaxial connector's characteristic impedance, for example 75 Ohm devices, filter and switch geometry may be varied to balance filtering performance while maintaining a desired characteristic impedance within an acceptable range, for example within a plus/minus 10 Ohm range.

By selecting filtering performance related dimensions and materials, embodiments of the present invention reduce stray signal ingress while maintaining return loss performance. For example, embodiments maintain the Society of Cable Television Engineer's ("SCTE") recommended minimum return loss of 20 dB.

Applicant notes that in telecommunications, return loss is the loss of signal power resulting from the reflection caused by a discontinuity in a transmission line. This discontinuity can be a mismatch with the terminating load or with a device inserted in the line.

Return loss is usually expressed in decibels dB $$RL(\text{dB}) = 10\ \log_{10}\frac{P_i}{P_r}$$

where RL (dB) is the return loss in dB, Pi is the incident power and Pr is the reflected power. Return loss is related to both standing wave ratio (SWR) and reflection coefficient (Γ). Increasing return loss corresponds to lower SWR. Return loss is a measure of how well devices or lines are matched. A match is good if the return loss is high. A high return loss is desirable and results in a lower insertion loss.

Embodiments of the invention provide a method of reducing RF cable interconnection ingress and/or egress. In various embodiments, unwanted coaxial connector and/or coaxial connection RF transfer is reduced by including a filter such as a waveguide and/or a switch such as a connector center conductor switch.

A purpose of some embodiments of the invention is to maximize the RF shielding or ingress at low frequency while providing a good impedance match of the connector interface during operation. The inventor found that the thickness of the end surface or shield disc can also be an important factor in some embodiments. For example, thicknesses in the range of 0.5 to 1.5 mm were found to be effective in blocking frequencies under 100 MHz.

An embodiment of the invention uses a 2 mm aperture. And, some embodiments use tuned slots in addition to the 2 to 3.5 mm aperture. These slots or waveguide bars may be added to the port end surface or to an internal shield disc for attenuation of particular frequencies.

An embodiment of the invention uses a shield disc from a polymer or ceramic material that can be coated or impregnated with a magnetic material active at specific frequencies. In addition to being homogeneously mixed with the ceramic or polymer, the material can be deposited or sputtered on the shield disc surface in different thicknesses or patterns to better affect specific frequencies. The shield may be a combination of waveguide and sputters or deposited material to more economically produce the shield. Discs made of two or more materials can be described as hybrid discs.

In various embodiments, the invention comprises: an outer connector body; a female end of the connector is for engaging a male coaxial cable connector; the connector female end having a waveguide with an aperture for receiving a center conductor; wherein the diameter of the aperture is in the range 1.3 mm to 3.0 mm; and, wherein the waveguide is configured to shield selected connector body internals from ingress of radio frequency signals in the range of 10 to 100 MHz, in the range of 10 to 1000 MHz, and in the range of 10 to 2150 MHz.

And, in some embodiments, the connector further comprises: a waveguide surface; the waveguide surface bordering the aperture and an aperture centerline about perpendicular to the waveguide surface; the thickness of a waveguide surface measured along a line parallel to the aperture centerline is not less than 0.5 mm; and, the thickness of the waveguide surface measured along a line parallel to the aperture centerline is not more than 1.5 mm.

And, in some embodiments, the diameter of the waveguide aperture and the thickness of the waveguide are selected in a manner consistent with achieving a connector impedance of 75 ohms. And, in some embodiments, the connector further comprises: a rim of the connector body; and, the waveguide is formed by the rim. And, in some embodiments the connector alternatively comprises: a rim or shoulder of the connector body; and, the waveguide formed by a disc held in place by the rim.

And, in various embodiments, the invention comprises: an outer connector body; a female end of the connector is for engaging a male coaxial cable connector; the connector female end having a waveguide with an aperture for receiving a center conductor; the diameter of the aperture is not less than two times the diameter of the center conductor; the diameter of the aperture is not more than 4 times the diameter of the center conductor; and, wherein the waveguide is configured to shield selected connector body internals from ingress of radio frequency signals in the range of 10 to 100 megahertz, 10 to 1000 megahertz, and 10 to 2150 megahertz while maintaining a nominal connector impedance of 75 ohms.

And, in some embodiments, the connector further comprises: a waveguide surface; the waveguide surface bordering the aperture and an aperture centerline about perpendicular to the waveguide surface; the thickness of a waveguide surface measured along a line parallel to the aperture centerline is not less than 0.5 mm; and, the thickness of the waveguide surface measured along a line parallel to the aperture centerline is not more than 1.5 mm.

And, in some embodiments, the connector further comprises: wherein the diameter of the aperture and the thickness of the waveguide are selected in a manner consistent with achieving a connector impedance of 75 ohms. And, in some embodiments, the connector further comprises: a rim of the connector body. And, in some embodiments, the connector alternatively comprises: a rim of the connector body; and, the waveguide formed by a disc held in place by the rim.

Yet other embodiments of the invention comprise a female connector with a body hole or separate entry disc hole opening from 1.5 to 3 mm port with a thickness of 0.5 to 1.5 mm. In some embodiments, the disc is made from a metallic material and in some embodiments the disc is made from a metallically impregnated polymer or ceramic material. Some embodiments of the disc are made with additional waveguide slots and some embodiments of the disc are made including one or more of a polymer, ceramic, or fiberglass material for example with a sputtered or etched magnetic material on the surface.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DESCRIPTION OF THE PREFERRED EMBODIMENTS

The disclosure provided herein describes examples of some embodiments of the invention. The designs, figures, and descriptions are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

Unless otherwise stated, as used herein the term "coupled" includes direct and indirect connections. As such, where first and second devices are coupled, intervening devices including active devices may be located therebetween.

Figure 2:
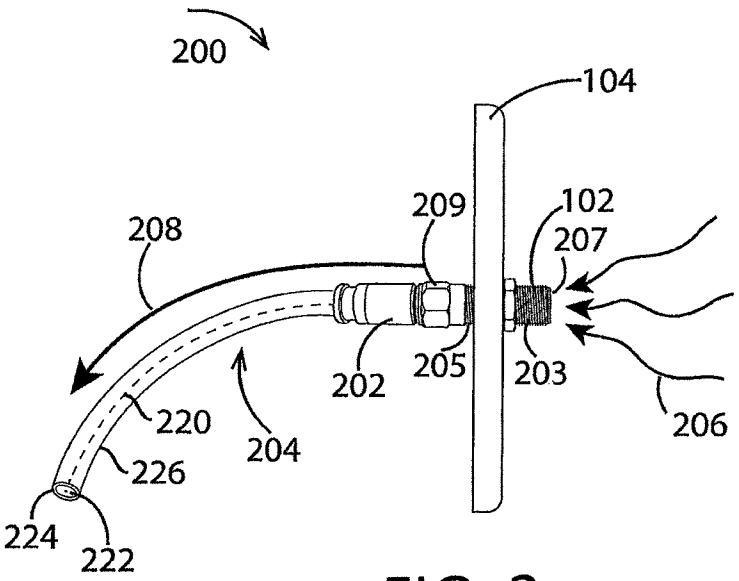
FIG. 2 (Prior Art)
FIG. 2 shows a prior art CATV wall plate that is a source of ingress of interfering RF signals.
Figure 1:
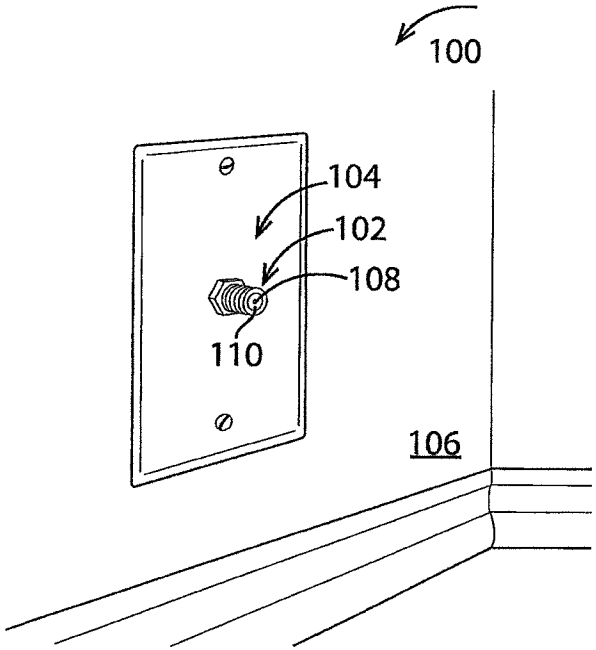
FIG. 1 (Prior Art)
FIG. 1 shows a prior art CATV wall plate with an F female connector or a splitter connector with a mated F female connector.
Figure 3A:
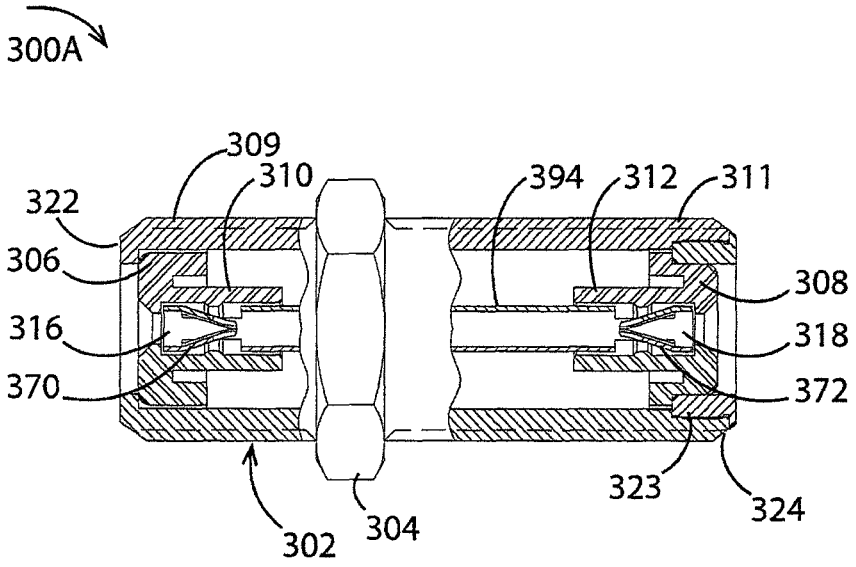
FIG. 3A (Prior Art)
FIGS. 3A and 3B show a prior art standard F female splice (commonly called F-81) with F contacts on both ends.
Figure 3B:
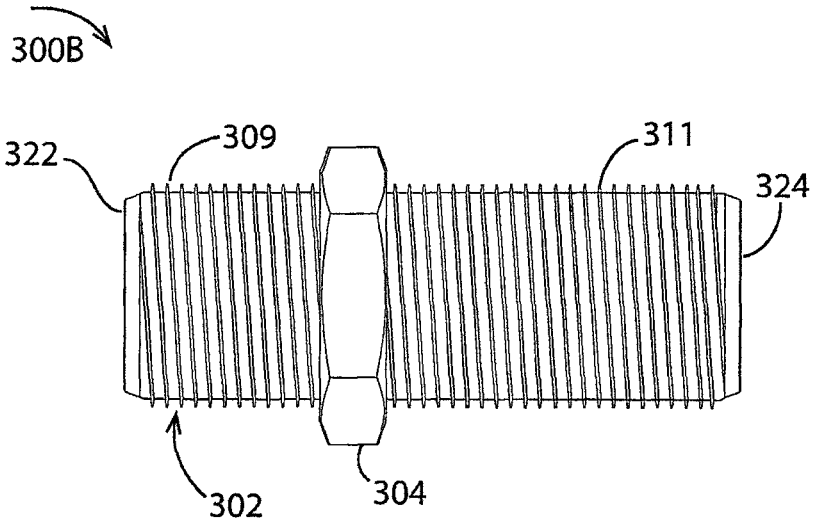
FIG. 3B (Prior Art)
Figure 4A:
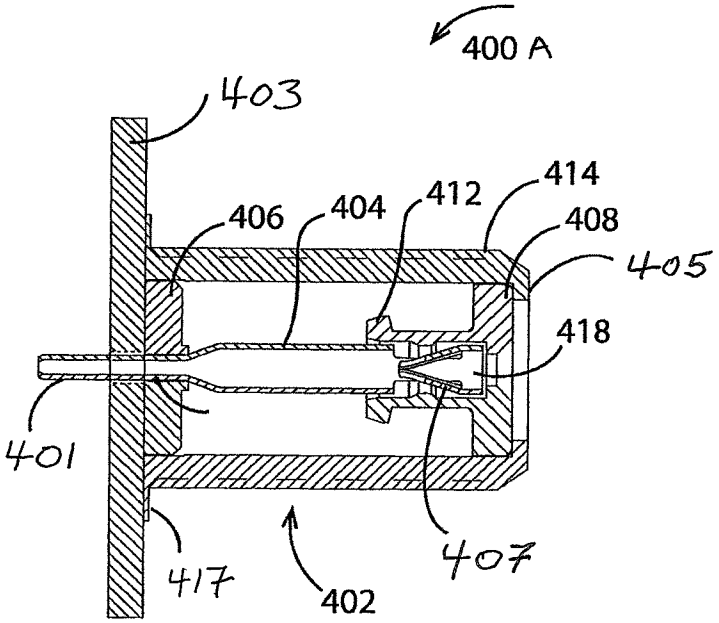
FIG. 4A (Prior Art)
FIG. 4A shows a prior art standard F female bulkhead coaxial connector (commonly called an F-61).
Figure 4C:
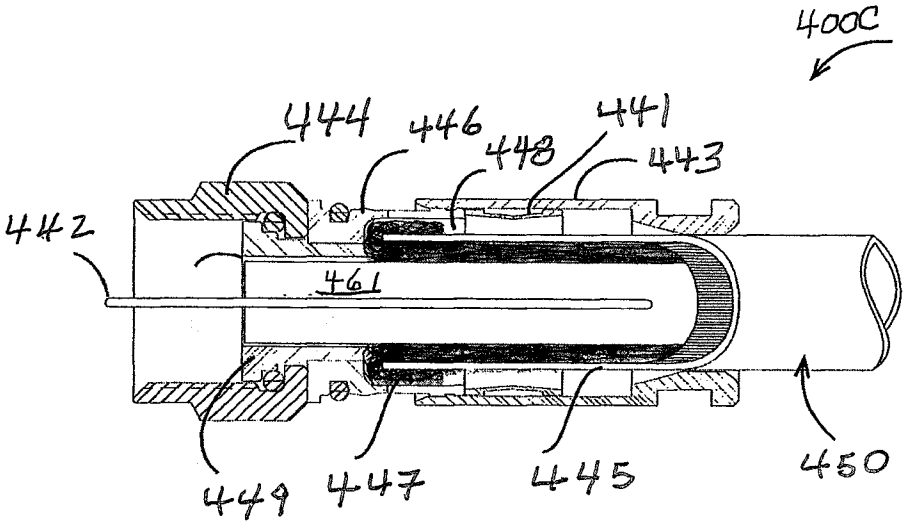
FIG. 4C (Prior Art)
FIG. 4C shows a prior art male F connector with a compression type cable attachment.
Figure 4B:
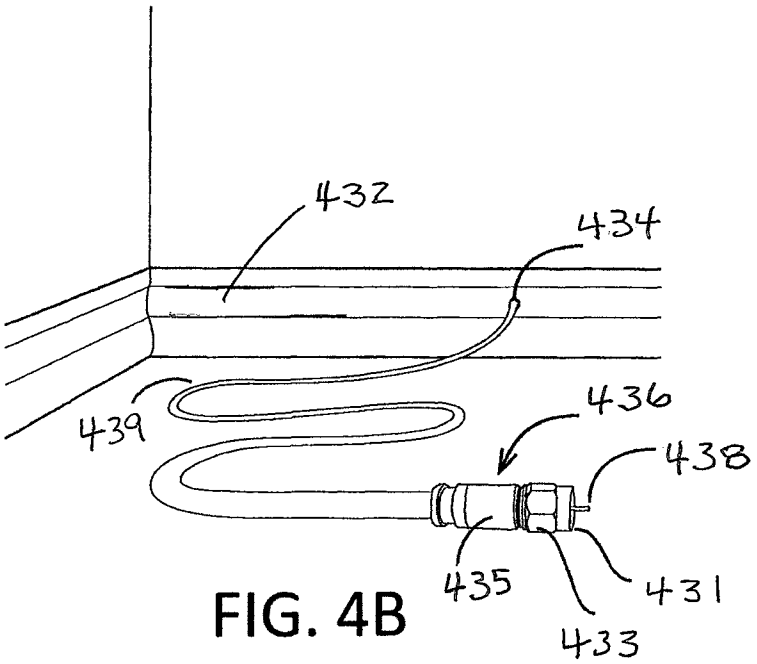
FIG. 4B (Prior Art)
FIG. 4B shows a prior art CATV installation having a cable terminated with a male F connector.
Figure 4D:
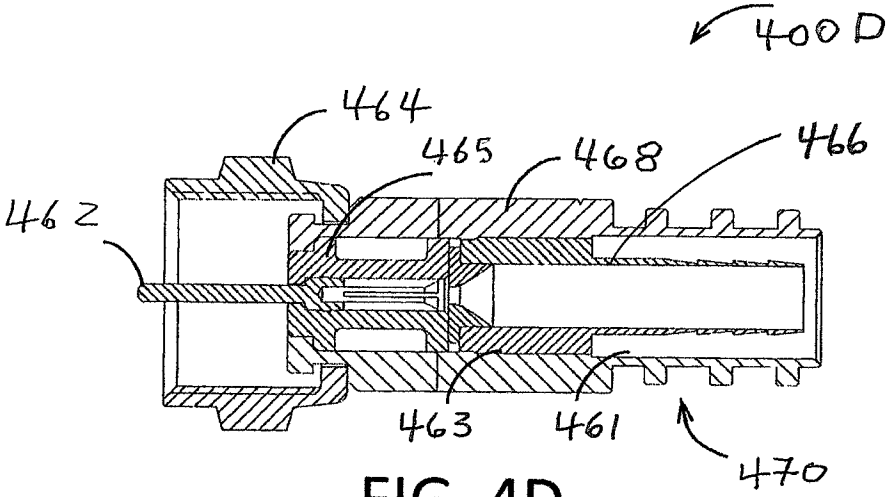
FIG. 4D (Prior Art)
FIG. 4D shows a prior art male F connector with a crimp type cable attachment.
Figure 5A:
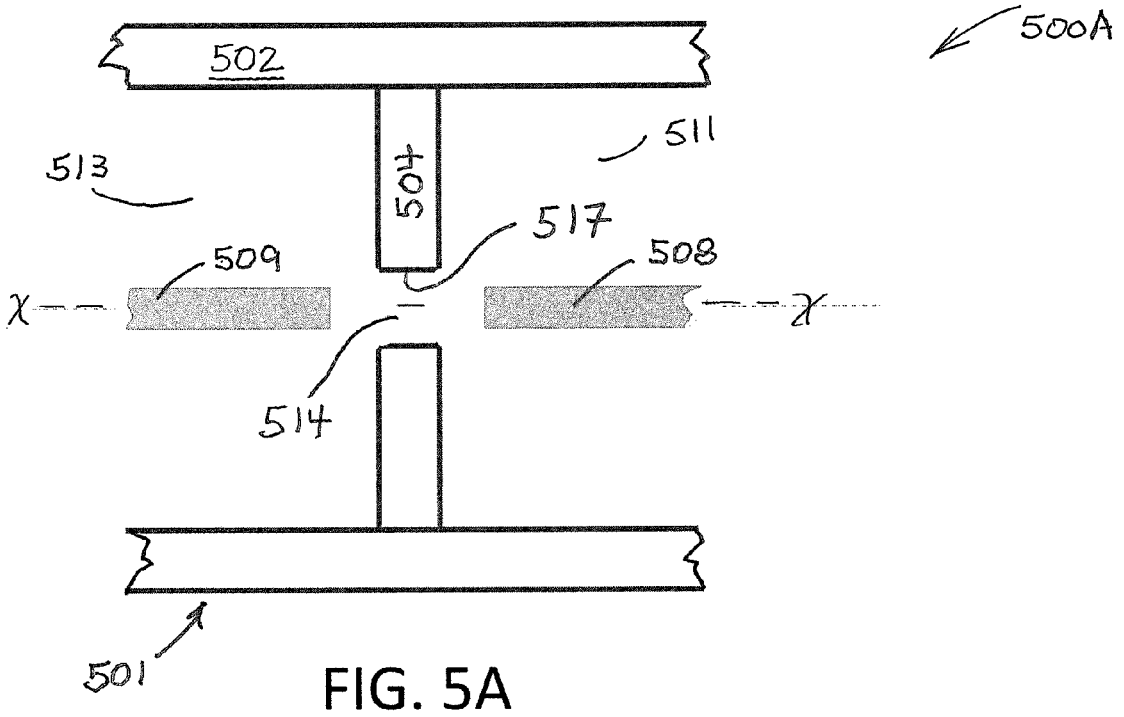
FIGS. 5A-B show exemplary schematics of waveguides mounted within a coaxial connector.
Figure 5B:
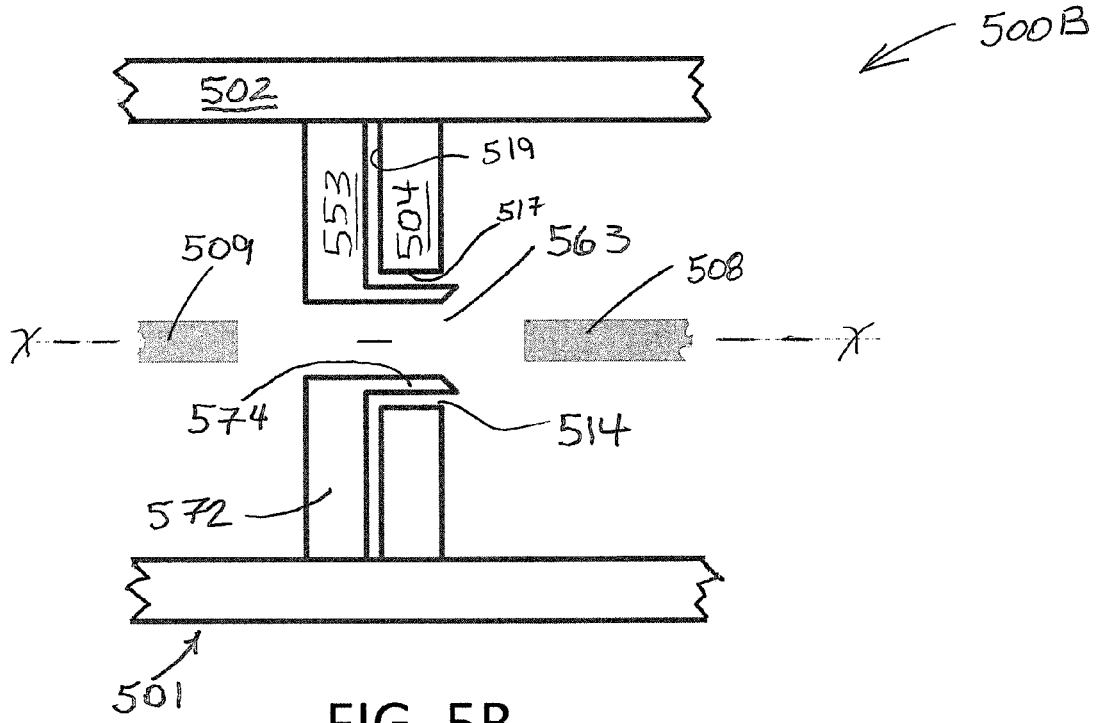
Figure 5C:
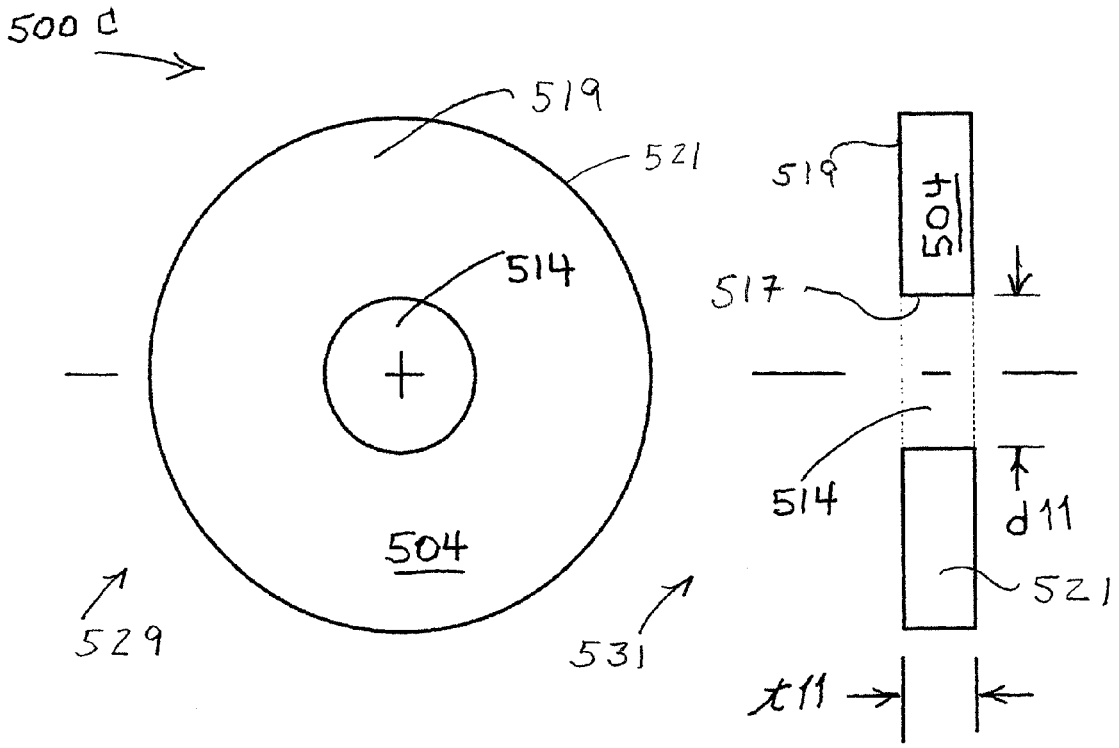
FIG. 5C shows an exemplary waveguide disc.
Figure 5D:
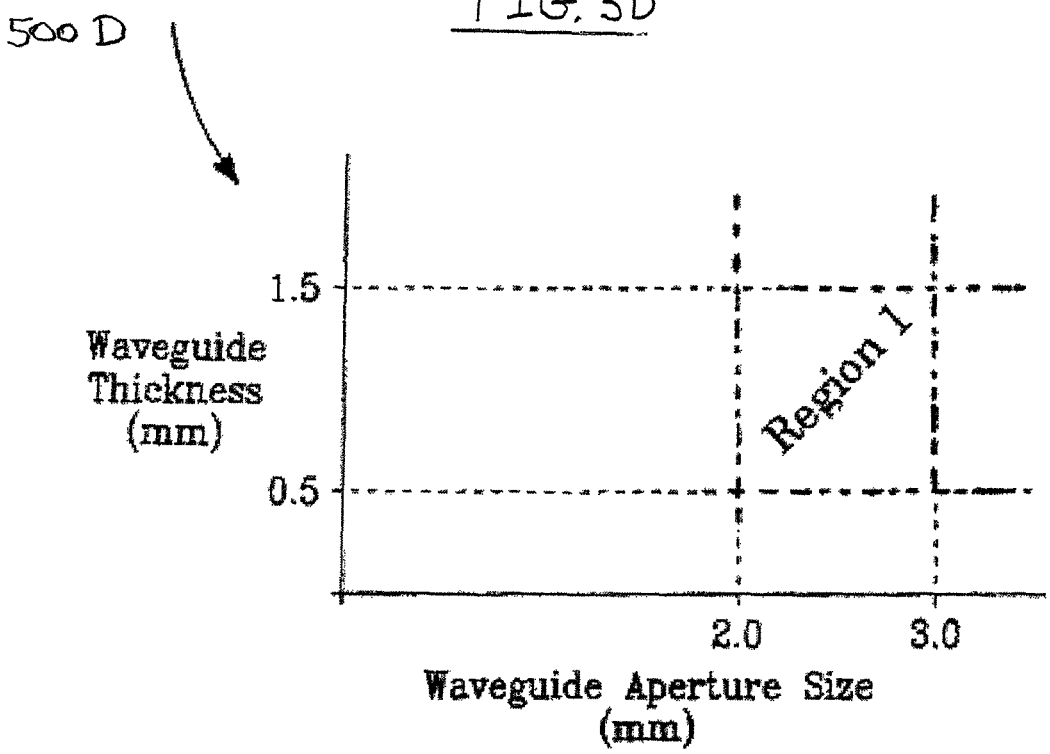
FIGS. 5D-E show exemplary waveguide dimensions.
Figure 5E:
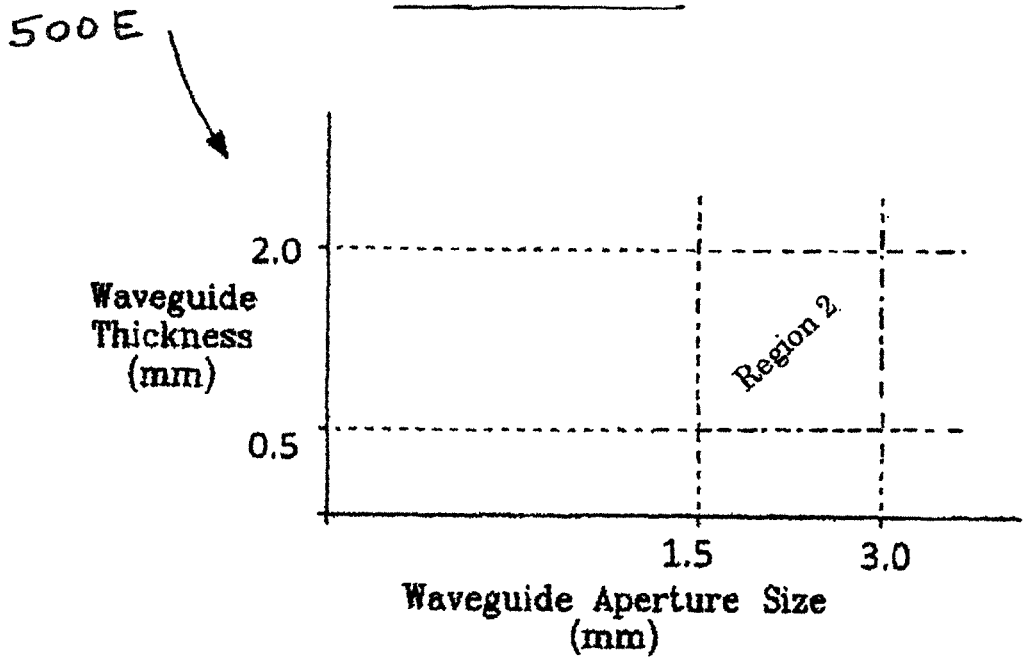

FIGS. 5A-C show schematics of a waveguide and of a waveguide in a connector 500A-C and FIGS. 5D-E illustrate selected waveguide dimensions 500D-E.

FIG. 5A shows a first coaxial connector schematic 500A. A coaxial connector 501 includes a body 502 and a waveguide 504 having a central aperture 514. The body is coaxially arranged with respect to a connector longitudinal axis x-x and the waveguide is located such that the x-x axis passes through the waveguide aperture. The waveguide and the body are electrically coupled, for example by mounting the waveguide to the body.

As shown, the waveguide 504 is located within a body or tube 502. For example, the waveguide might be positioned at or near one end of the body. For example, the waveguide might be positioned in a position intermediate between the ends of the body such as near the midpoint of a line extending between the ends of the body.

Also shown are center conductors 508, 509. Center conductor 508 is substantially to one side 511 of the waveguide 504 and center conductor 509 is substantially to the other side 513 of the waveguide. One or both of the center conductors 508, 509, may be part(s) of the connector 501. In various embodiments, one of the center conductor ends may be located in the waveguide aperture.

As skilled artisans will recognize, the center conductors 508, 509 conduct electrical signals. These conducted signals may be present because of a physical or an electrical interconnection with the signal source. Signals may also be present in the conductor because the conductor receives, like an antenna, RF signal(s).

When a center conductor that is electrically interconnected with signal processing equipment is disconnected or "open" at one end, the disconnected end can become an antenna for RF signals. For example, if center conductor 508 is electrically connected with a CATV distribution system, then RF signals that reach center conductor 508 are subsequently electrically conducted to the distribution system. Such random signal ingress is generally undesirable.

A properly sized waveguide reduces ingress when it substantially prevents undesired signals from crossing the waveguide or passing through the waveguide aperture. In the example of FIG. 5A, undesirable RF signals present at location 513 are attenuated by the waveguide 504 such that the center conductor 508 on the opposite side 511 of the waveguide 504 is protected or shielded from ingress of undesired signals.

To the extent the adjacent center conductor 509 radiates undesirable RF signals, a properly sized waveguide 504 separating the center conductors 508, 509 shields the adjacent center conductor 508 and attenuates undesirable signals that would otherwise reach the CATV distribution system largely unattenuated.

FIG. 5B shows a connector such as the connector of FIG. 5A fitted with an insulator 500B.

In various embodiments the center conductors 508, 509 are signal conductors while the body 502 and interconnected waveguide 504 are typically ground conductors. As such, the connector 501 may be constructed, as shown, such that the signal conductors and ground conductors are electrically isolated.

Because one of the center conductors 508, 509 may risk contact with the waveguide 504 due to proximity and/or due to movement with respect to the body 502, some embodiments of the connector 501 include a waveguide insulator 553 for maintaining electrical isolation.

Such an insulator may cover surface(s) of the waveguide 519 perpendicular to a center conductor 508, 509 and/or the bore 517 of the aperture 504. For example, the figure shows an insulator 553 having a planar portion 572 covering the perpendicular surface. The insulator also includes a neck portion 574 that is inserted into the aperture bore. In an exemplary configuration, this arrangement guards against contact of a center conductor 509 (such as a moving center conductor) with either of the facing waveguide surface 519 and/or the aperture bore 517.

FIG. 5C shows a waveguide 500C. In a front view 529 and a side view 531 of the waveguide 504, an annular surface 519 extends from a central aperture 514 to a peripheral rim 521. The waveguide shown has a generally cylindrical shape and the aperture extends between ends of the cylinder. In the side view 531, the waveguide thickness t11 and waveguide aperture diameter d11 are indicated.

In other embodiments, the waveguide 504 need not have a cylindrical shape. For example a non-cylindrical waveguide might be used for mating with a non-cylindrical support extending from the connector body or where a connector body accommodates a waveguide of a different shape such as a polygonal or other non-circular shape.

FIG. 5D shows a first exemplary chart 500D of waveguide thickness t11 and waveguide aperture size d11. In particular, the chart shows ranges of aperture size and thickness within a particular region, Region 1, found to yield desirable RF ingress attenuation in CATV applications.

The figure illustrates thickness and aperture size ranges tested in connection with rejecting unwanted signals in the frequency band 100 MHz and below. Region 1 is bounded by aperture sizes d11 of approximately 2.0 to 3.0 mm and waveguide thicknesses t11 of approximately 0.5 to 1.5 mm. Notably, beneficial rejection of unwanted signals in the frequency spectrum between 100 MHz and 2150 MHz has also been observed.

Several waveguides with dimensions in Region 1 were found to be useful for blocking unwanted RF ingress typical of CATV applications. For example, in various embodiments an F female connector is shielded to restrict RF transfer at frequencies below 100 MHz while allowing the connector to mate with a male coaxial connector with insignificant degradation of a desired 75 ohm impedance.

FIG. 5E shows a second exemplary chart of waveguide thickness t11 and waveguide aperture size d11. In particular, the chart shows ranges of aperture size and thickness within a particular region, Region 2, found to yield desirable RF ingress attenuation in CATV applications. The figure illustrates thickness and aperture size ranges tested in connection with rejecting unwanted signals in CATV distribution frequency bands. Notably, beneficial rejection of unwanted signals in the frequency spectrum below 100 MHz, in the frequency spectrum from 10 to 1000 MHz, and in the frequency spectrum from 10 to 2050 MHz has been observed.

Here, the 0.3 to 1000 MHz and in particular the 700-800 MHz frequency band is of interest due to cellular telephone signal ingress such as 4G and/or LTE phone signal ingress in a cell phone/CATV an overlapping (700-800 MHz) frequency range. Region 2 is bounded by aperture sizes of approximately 1.5 to 3 mm and waveguide thicknesses of approximately 0.5 to 2 mm.

Figure 6A:
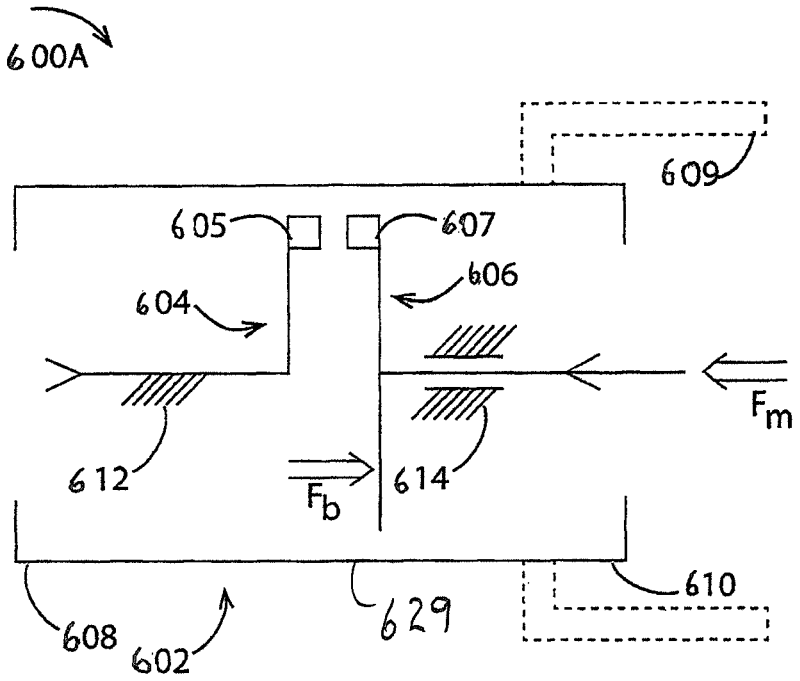
FIGS. 6A-B show exemplary schematics of a disconnect switch mounted within a coaxial connector.
Figure 6B:
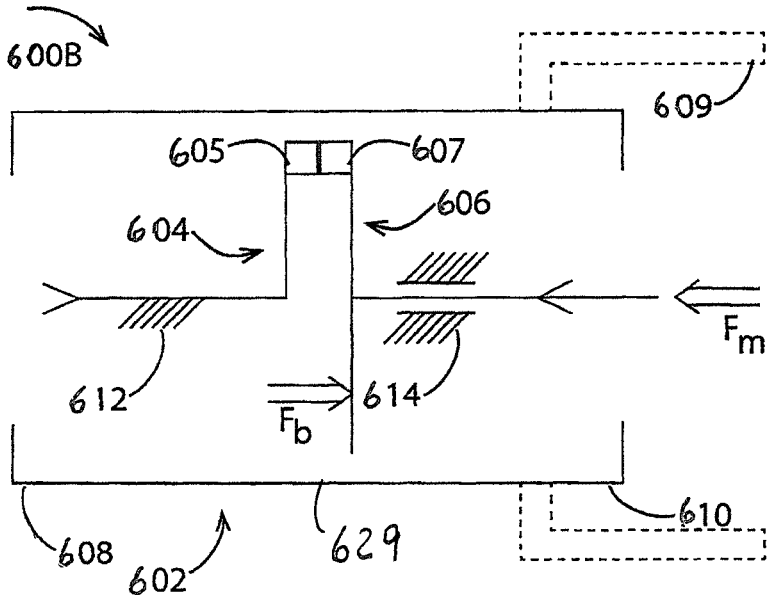

FIGS. 6A-B are schematic drawings illustrating a coaxial connector shielded with a center conductor switch 600A-B. The connector includes a tubular body 602 having opposing ends 608, 610, at least one of which is for receiving a mating male or female coaxial cable connector. Some embodiments include a fastener 609 for engaging a female coaxial connector such as a port.

A stationary contact assembly 604 is near a first end of the body 608 and a movable contact assembly 606 is near a second end of the body 610. The stationary contact assembly is at least partially within the body 602 and the movable contact assembly is only partially within the body such that a biasing force Fb acting on the movable contact assembly tends to separate a stationary contact 605 of the stationary contact assembly and a movable contact 607 of the movable contact assembly. In various embodiments, a front support 612 fixedly couples the stationary contact assembly to the body while a rear support enables motion of the movable contact relative to the body. For example, a sliding contact rear support 614 enables the movable contact to slide relative to the body. And, in various embodiments one or both of the front and rear supports provide an electrical insulating barrier between the body 602 and at least one of the contacts 605, 607.

A feature of this connector is seen in FIG. 6B when the biasing force Fb is overcome by a moving force Fm, pushing the movable contact assembly 606 in the direction of the body's first end such that the contacts 605, 607 press together. In various embodiments the moving force is supplied by a coaxial connector that engages the second end of the body 610. Exemplary biasing force means include springs, spring-like materials, gas struts or springs, resilient materials, resilient structures, elastic materials, elastic structures, and the like.

As skilled artisans will appreciate, the series disconnect switch illustrated in FIGS. 6A-B provides separation between center conductors when the connector does not engage a mating connector. To the extent one of the center conductors is interconnected with a cable distribution system, the separation avoids conduction of electrical signals between the separated portions of the center conductor. For example, if the connector of FIG. 6A does not engage a mating connector and if conductor 604 is electrically connected with cable television signal distribution equipment, electrical isolation of conductor 606 via separation of contacts 605, 607 as shown in FIG. 6A avoids conduction of electrical noise picked up by conductor 606. In particular, when portions of conductor 606 lie outside the connector body 629, they are unshielded receiving antennas for stray electromagnetic noise such as radio frequency noise in a CATV frequency band.

The shielding devices of FIGS. 6A-B are applicable to a variety of coaxial connector types. Exemplary connector types include F-Type, MCX, PAL, G Series, IEC, and the like. The shielding devices of FIGS. 6A-B are also applicable to a variety of coaxial connector configurations including single and double ended devices, for example splices, male and female connectors, adapters, and the like.

Figure 7A:
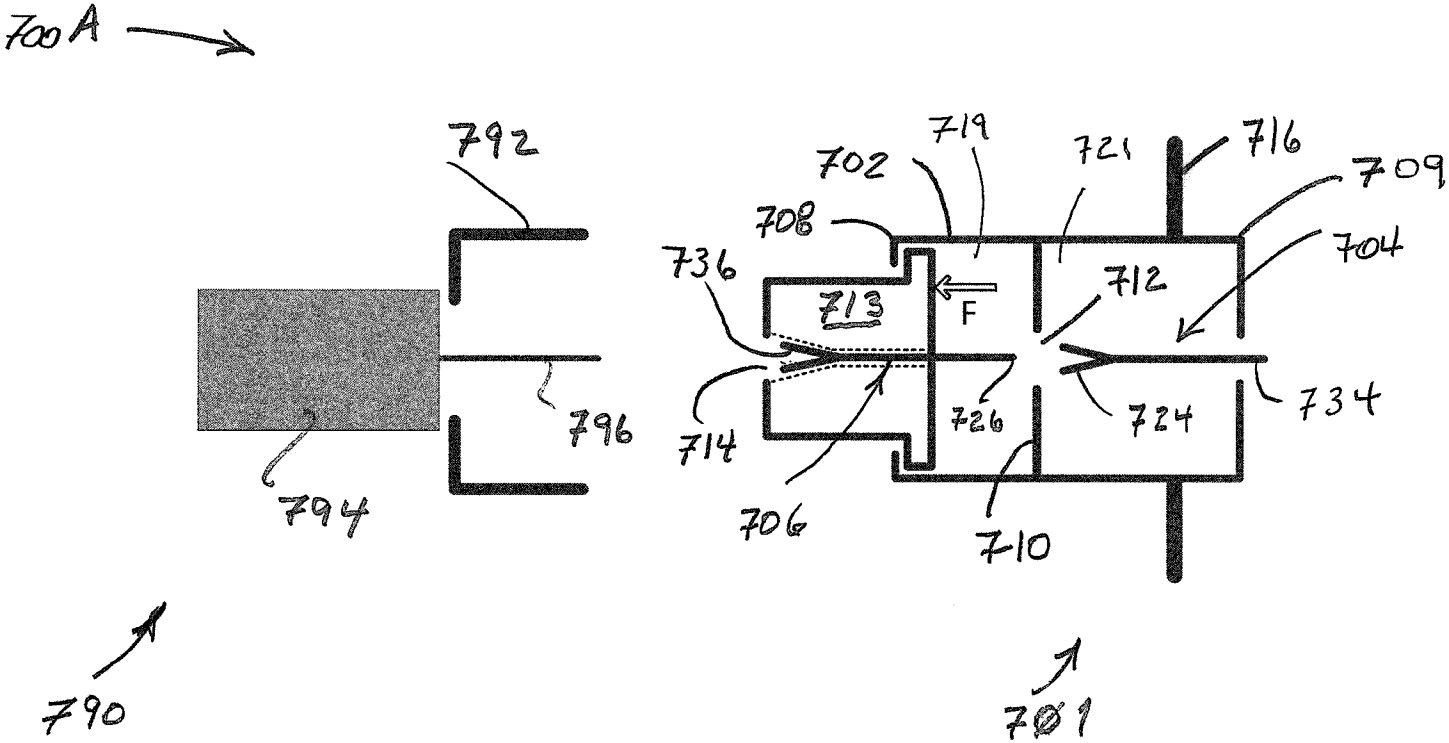
FIGS. 7A-C show exemplary schematics of coaxial connectors with both a waveguide and a disconnect switch.
Figure 7B:
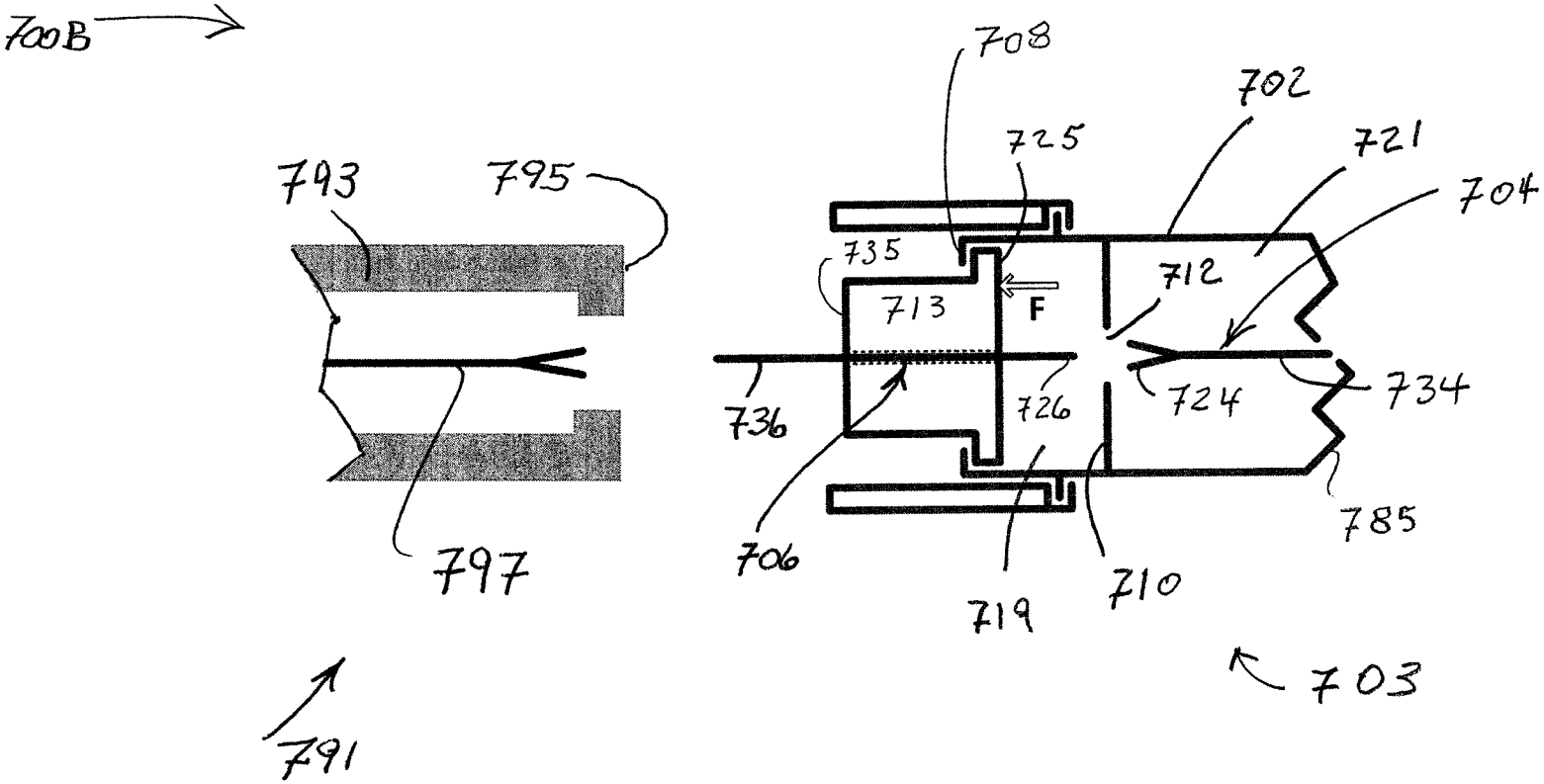
Figure 7C:
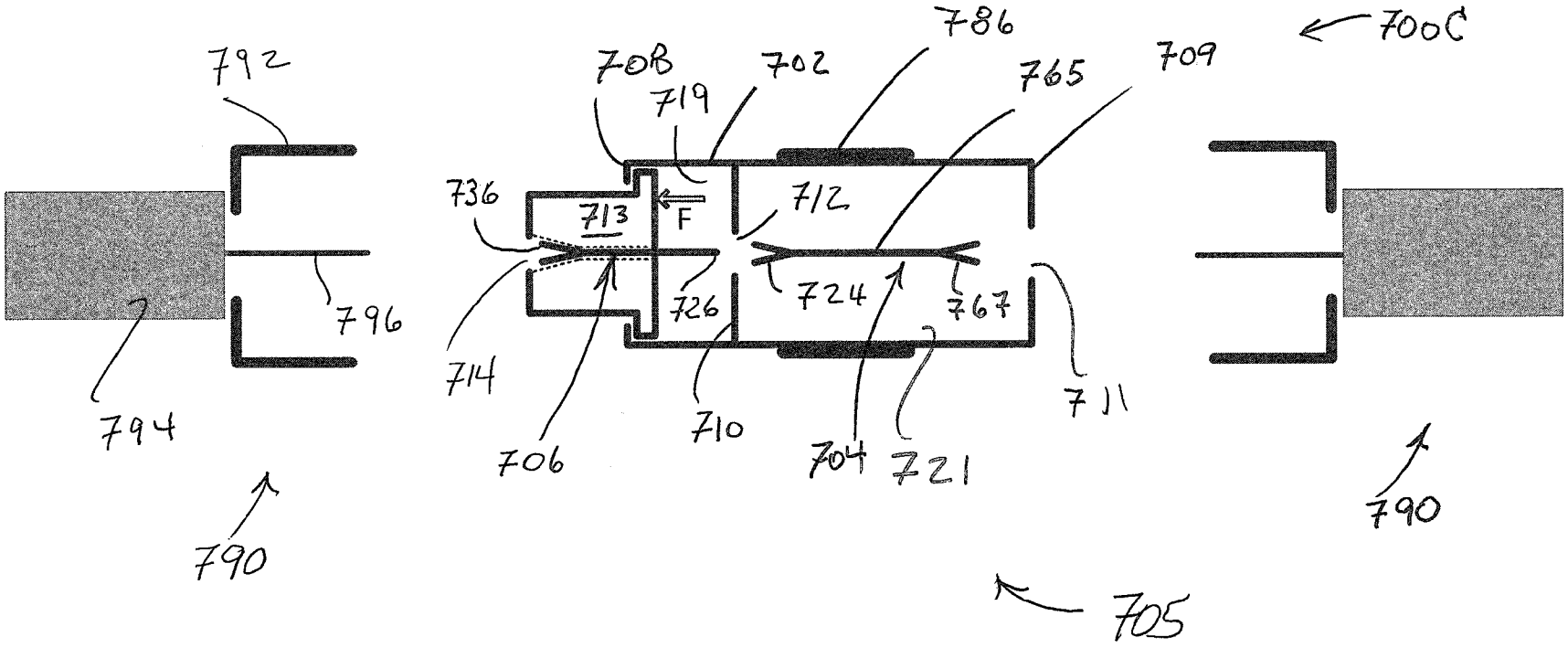

FIGS. 7A-C are schematic drawings illustrating coaxial connectors with combined shielding including a disconnect switch and a waveguide.

FIG. 7A is a schematic drawing illustrating a single ended female coaxial connector such as an equipment port 700A. A connector body 702 having first and second ends 708, 709 includes a base 716 near the second end 709. A nose 713 is urged by a force such as a spring force F to protrude from the first end 708 of the body. The nose may be described as an actuator here and elsewhere in this specification.

A disconnect switch includes a stationary conductor 704 and a moving conductor 706 carried by the nose 713. A stationary conductor end such as a terminal 734 protrudes from the body second end 709 and a moving conductor end such as a socket 736 accessible via a nose opening 714 is urged to protrude from the body first end 708. A stationary conductor contact 724 is adjacent to a moving conductor contact 726 and these contacts selectively mate according to positioning of the nose 713 which operates the disconnect switch.

A waveguide 710 with a central aperture 712 is electrically coupled to the body 702. The waveguide is located within the body and divides first 719 and second 721 body chambers. The moving and stationary conductors are located substantially to either side of the waveguide such that depressing the nose advances the moving conductor contact 726 through the waveguide aperture 712.

Shown adjacent to the port 701 is an exemplary male connector 790 for engagement with the first end of the port. The male connector includes a center conductor 796, a connector body 794, and a fastener 792. When engagement occurs, the male connector center conductor 796 enters the nose accessway 714 and contacts the moving conductor exposed end 736. In addition, the nose 713 is depressed as the male connector pushes the nose into the body 702. This mating process advances the moving conductor contact 726 through the aperture 712 and closes the disconnect switch.

In various embodiments, the connector conductors include or are made from metal(s) or metal alloy(s) such as copper and copper alloys. In various embodiments, the connector body (or a sleeve encircling the body, not shown) includes or is made from metal(s) or metal alloy(s). In various embodiments, the waveguide includes or is made from metal(s) or metal alloy(s). In some embodiments, the nose provides an electromagnetic shield, for example via inclusion of metal(s) or metal alloy(s). Examples include a metal cap, coating, or layer covering an exterior of the nose, metal in a nose matrix material such as plastic, a metallic nose insulated from the integral moving conductor, and the like.

As skilled artisans will recognize, when the connector 701 is not mated, the waveguide attenuates signal flow via RF free space transmission between the moving and stationary conductors 706, 704 and the disconnect switch stops signal flow via conduction between the moving and stationary conductors. In various embodiments, waveguide performance may be enhanced by positioning a conductor contact 726, 724 within the aperture when the connector nose 713 is fully extended. For example, the moving conductor contact 726 may be so positioned. Such positioning may enhance grounding of stray signals. And, in various embodiments waveguide performance may be enhanced by positioning a conductor contact 726, 724 to one side of the aperture when the connector nose 713 is fully extended. For example, the stationary conductor may be so positioned. Such positioning may enhance grounding of stray signals. In an embodiment, the moving contact 726 is positioned within the aperture and the stationary contact 724 is positioned to one side of the aperture. And, in an embodiment, the waveguide is located between the stationary and moving contacts.

FIG. 7B is a schematic drawing illustrating a single ended male coaxial connector 700B. A connector body 702 extends from a first end 708 toward 785 a second end (not shown). A nose 713 is urged by a force such as a spring force F to protrude from the first end 708 of the body.

A disconnect switch includes a centrally located stationary conductor 704 and a centrally located moving conductor 706 carried by the nose 713. The stationary conductor extends 734 from a nose directed end 724 toward 785 the second body end. The moving conductor is carried by the nose and has opposed outward and inward ends 736, 726 protruding from opposed outward and inward sides 735, 725 of the nose.

The stationary conductor nose directed end 724 provides a contact such as a socket and the moving conductor inward end provides a mating contact such as a pin 726. These contacts selectively mate according to positioning of the nose 713 which operates the disconnect switch.

A waveguide 710 is electrically coupled to the body 702. The waveguide is located within the body and divides first 719 and second 721 body chambers. The moving and stationary conductors are located substantially to either side of the waveguide such that depressing the nose advances the moving conductor contact 726 through the waveguide aperture 712.

Shown adjacent to the connector 703 is an exemplary female coaxial connector 791 for engaging the male connector 703. The female connector includes a center conductor 797, a connector body 793 and a connector forward end 795. When engagement of the connectors occurs, the male connector center conductor outward end 736 engages the female connector center conductor and the forward end of the female connector 795 pushes the male connector nose 713 into the body. As the nose 713 is depressed the moving conductor inward contact 726 is advanced through the aperture 712 such that the disconnect switch is closed when the moving conductor inward contact mates with the stationary contact nose directed end 724.

In various embodiments, the connector conductors include or are made from metal(s) or metal alloy(s) such as copper and copper alloys. In various embodiments, the connector body (or a sleeve encircling the body, not shown) includes or is made from metal(s) or metal alloy(s). In various embodiments, the waveguide includes or is made from metal(s) or metal alloy(s). In some embodiments, the nose provides an electromagnetic shield, for example via inclusion of metal(s) or metal alloy(s). Examples include a metal cap, coating, or layer covering an exterior of the nose, metal in a nose matrix material such as plastic, a metallic nose insulated from the integral moving conductor, and the like.

As skilled artisans will recognize, when the connector 703 is not mated, the waveguide attenuates signal flow via RF free space transmission between the moving and stationary conductors 706, 704 and the disconnect switch stops signal flow via conduction between the moving and stationary conductors. In various embodiments, waveguide performance may be enhanced by positioning a conductor contact 726, 724 within the aperture when the connector nose 713 is fully extended. For example, the moving conductor contact 726 may be so positioned. Such positioning may enhance grounding of stray signals. And, in various embodiments waveguide performance may be enhanced by positioning a conductor contact 726, 724 to one side of the aperture when the connector nose 713 is fully extended. For example, the stationary conductor may be so positioned. Such positioning may enhance grounding of stray signals. In an embodiment, the moving contact 726 is positioned within the aperture and the stationary contact 724 is positioned to one side of the aperture. And, in an embodiment, the waveguide is located between the stationary and moving contacts.

FIG. 7C is a schematic drawing illustrating a double ended female coaxial connector such as a splice 700C. A connector body 702 has first and second ends 708, 709. A nose 713 is urged by a force such as a spring force F to protrude from the first end 708 of the body.

A disconnect switch includes a stationary conductor 704 and a moving conductor 706 carried by the nose 713. A stationary conductor end such as a socket 767 extends from a conductor link 765 and is located near a connector entryway 711 in the connector second end 709. A moving conductor end such as a socket 736 accessible via a nose opening 714 is urged to protrude from the body first end 708. A stationary conductor contact 724 extends from the link 765 and is adjacent to a moving conductor contact 726 and these contacts selectively mate according to positioning of the nose 713 which operates the disconnect switch.

A waveguide 710 is electrically coupled to the body 702. The waveguide is located within the body and divides first 719 and second 721 body chambers. The moving and stationary conductors are located substantially to either side of the waveguide such that depressing the nose advances the moving conductor contact 726 through the waveguide aperture 712.

Shown adjacent to the connector 705 is an exemplary male connector 790 for engagement with the first end of the connector 705. The male connector includes a center conductor 796, a connector body 794, and a fastener 792. When engagement occurs, the male connector center conductor 796 enters the nose access-way 714 and contacts the moving conductor exposed end 736. In addition, the nose 713 is depressed as the male connector pushes the nose into the body 702. This mating process advances the moving conductor contact 726 through the aperture 712 and closes the disconnect switch.

In various embodiments, the connector conductors include or are made from metal(s) or metal alloy(s) such as copper and copper alloys. In various embodiments, the connector body (or a sleeve encircling the body, not shown) includes or is made from metal(s) or metal alloy(s). In various embodiments, the waveguide includes or is made from metal(s) or metal alloy(s). In some embodiments, the nose provides an electromagnetic shield, for example via inclusion of metal(s) or metal alloy(s). Examples include a metal cap, coating, or layer covering an exterior of the nose, metal in a nose matrix material such as plastic, a metallic nose insulated from the integral moving conductor, and the like.

As skilled artisans will recognize, when the connector 701 is not mated, the waveguide attenuates signal flow via RF between the moving and stationary conductors 706, 704 and the disconnect switch stops signal flow via conduction between the moving and stationary conductors. In various embodiments, waveguide performance may be enhanced by positioning a conductor contact 726, 724 within the aperture when the connector nose 713 is fully extended. For example, the moving conductor contact 726 may be so positioned. Such positioning may enhance grounding of stray signals.

Figure 8A:
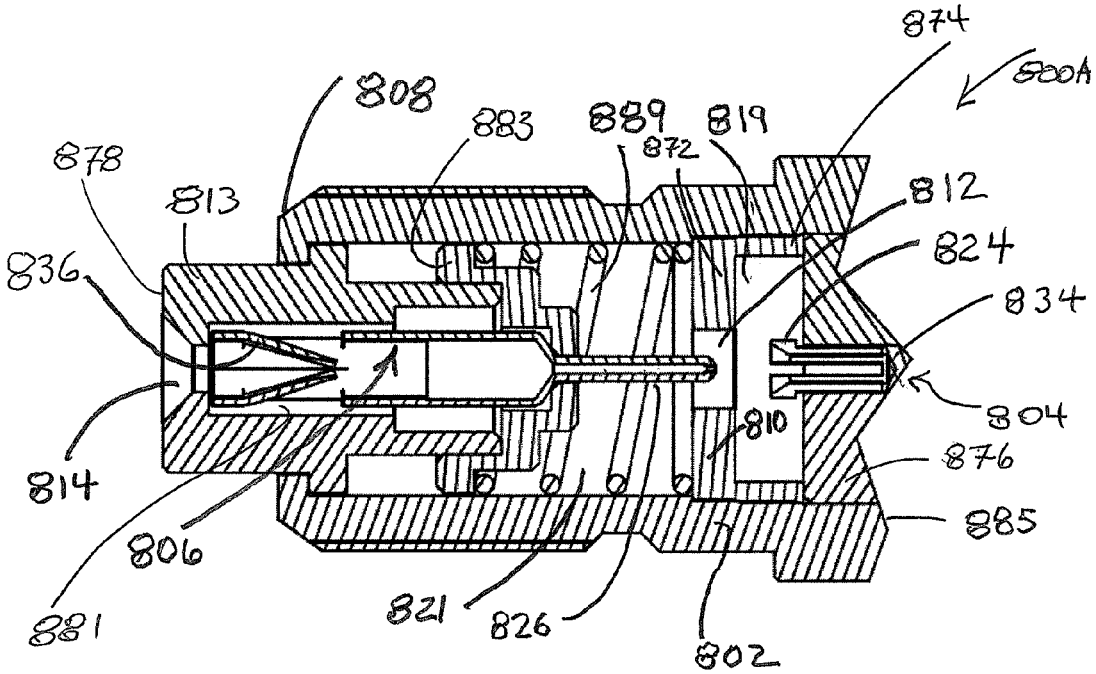
FIGS. 8A-B show a first coaxial connector with both a waveguide and a disconnect switch.
Figure 8B:
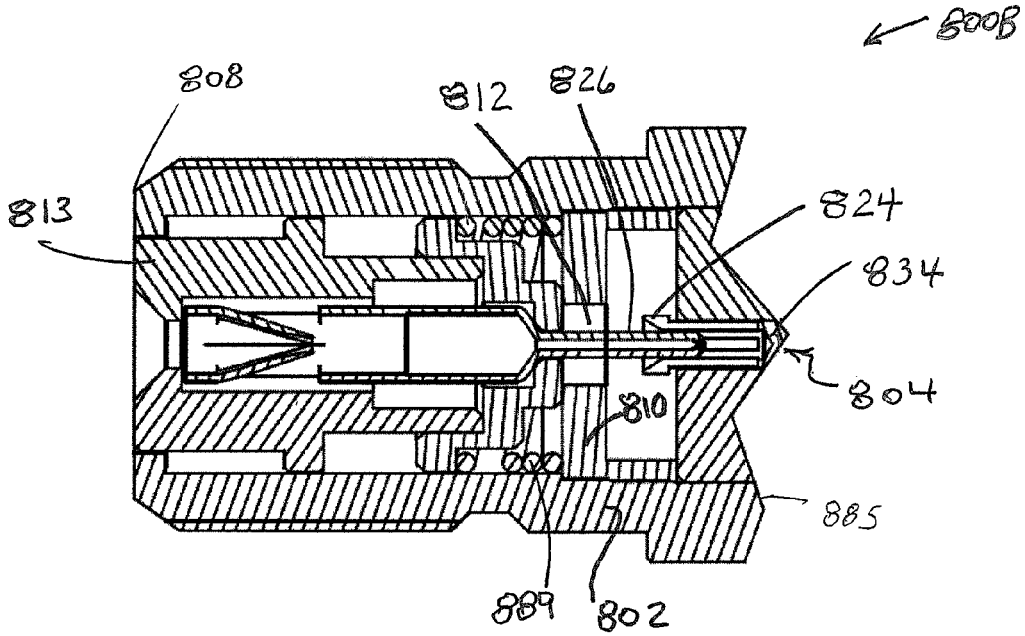

FIGS. 8A-B show cross sections of a first coaxial connector with combined shielding including a disconnect switch and a waveguide.

FIG. 8A shows a female end of a coaxial connector having an extended nose 800A. FIG. 8B shows the connector of FIG. 8A having a depressed nose 800B. The connector includes a body 802, a stationary conductor 804, a moving conductor 806, and a waveguide 810. In various embodiments each of these parts is a conductor of electricity.

The connector 800A also includes insulating part(s) that isolate the moving conductor 806 from the body 802. For example, a nose 813 or portions of the nose may be electrical insulators.

The connector body 802 has a first end 808 extending toward 885 a second end (not shown). The nose 813 is urged by a force to protrude from the first end 808 of the body. In various embodiments, the force may be provided by a resilient member such as a resilient solid or material, spring, gas charged device, or the like. In an embodiment a coil spring 889 encircles the moving conductor 806 and is located between the waveguide 810 and the body first end 808.

The nose 813 carries the moving conductor 806 in a nose cavity 881. In some embodiments the nose includes a nose internal cap 883 on which a spring such as the coil spring 889 bears.

A disconnect switch includes the stationary conductor 804 and the moving conductor 806. In various embodiments, the stationary conductor is electrically isolated from the connector body 802 via an insulating member such as an adjacent or supporting and/or substantially annular insulator 876.

The stationary conductor 804 includes a link or terminal portion 834 that extends toward 885 a second body end. The moving conductor 806 includes a socket 836 near the first body end 808. The socket 836 is accessible via a nose central passage or entryway 814 seen in an outer face 878 of the nose.

A stationary conductor contact such as a socket 824 adjoining the link 834 is adjacent to a moving conductor contact such as a pin 826 and these contacts selectively mate according to positioning of the nose 813 which operates the disconnect switch. As seen, as the nose is depressed, the spring 889 is compressed.

An exemplary waveguide 810 is electrically coupled to the body 802 and/or to a similar electromagnetic shield either within or without the body. As shown, a stand-off 874 spaces a gap between a waveguide aperture plate 872 and the stationary conductor insulator 876 to form a body chamber 819. The stand-off may be integral with the waveguide or not.

As shown, the waveguide 810 is located within the body 802 and divides first 819 and second 821 body chambers. Here and elsewhere, a waveguide dividing a connector body into similar separate chambers may be referred to as a mid-body waveguide. The moving and stationary conductors 806, 804 are located substantially to either side of the waveguide such that depressing the nose 813 advances the moving conductor contact 826 through the waveguide aperture 812.

In various embodiments, the connector conductors 804, 806 include or are made from metal(s) or metal alloy(s) such as copper and copper alloys. In various embodiments, the connector body 802 (or a sleeve encircling the body, not shown) includes or is made from metal(s) or metal alloy(s). In various embodiments, the waveguide 810 includes or is made from metal(s) or metal alloy(s).

In some embodiments, the nose 813 provides an electromagnetic shield, for example via inclusion of metal(s) or metal alloy(s). Exemplary electromagnetic shields include a nose metal cap, coating, or layer covering an exterior of the nose, metal in a nose matrix material such as plastic, a metallic nose insulated from the integral moving conductor, and the like.

As skilled artisans will recognize, when the connector 800A is not mated, the waveguide attenuages signal flow via RF free space transmission between the moving and stationary conductors 806, 804 and the disconnect switch attenuates or stops signal flow via conduction between the moving and stationary conductors. In various embodiments, waveguide performance may be enhanced by positioning a conductor contact 826, 824 within the aperture when the connector nose 813 is fully extended. For example, the moving conductor contact 826 may be so positioned (as shown). Such positioning may enhance grounding of stray signals. And, in various embodiments waveguide performance may be enhanced by positioning a conductor contact 826, 824 to one side of the aperture when the connector nose 813 is fully extended. For example, the stationary conductor may be so positioned. Such positioning may enhance grounding of stray signals. In an embodiment, the moving contact 826 is positioned within the aperture and the stationary contact 824 is positioned to one side of the aperture. And, in an embodiment, the waveguide is located between the stationary and moving contacts.

Figure 9B:
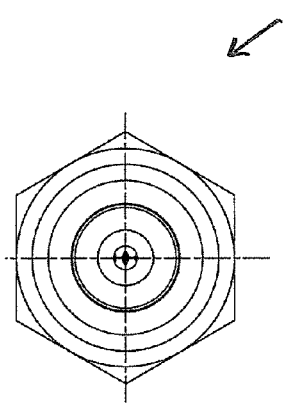
FIGS. 9A-C show a second coaxial connector with both a waveguide and a disconnect switch.
Figure 9A:
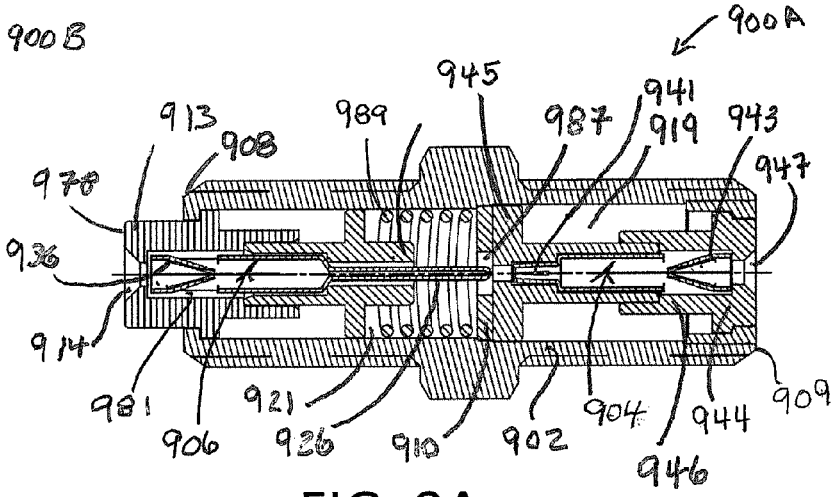
Figure 9C:
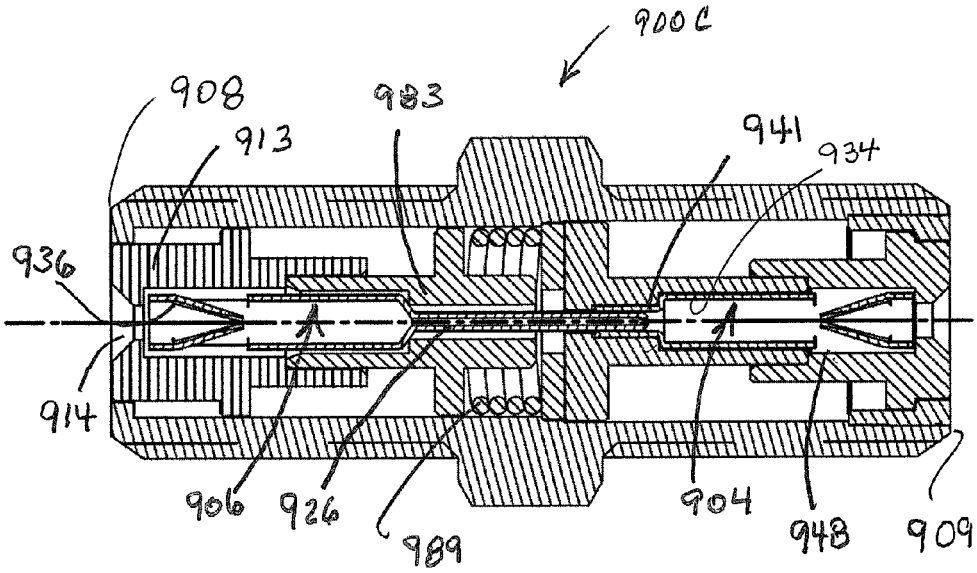

FIGS. 9A-C show cross sections of a second coaxial connector with combined shielding including a disconnect switch and a waveguide.

FIG. 9A shows a coaxial connector splice with an extended nose 900A. FIG. 9B shows a nose end view of the splice 900B. FIG. 9C shows the splice with the nose depressed 900C. The connector includes a body 902, a stationary conductor 904, a moving conductor 906, and a waveguide 910. In various embodiments each of these parts is a conductor of electricity.

The connector 900A also includes insulating part(s) that isolate the moving conductor 906 from the body 902. For example, a nose 913 or portions of the nose may be electrical insulators.

The connector body 902 has a first end 908 and a second end 909. The nose 913 is urged by a force to protrude from the first end 908 of the body. In various embodiments, the force may be provided by a resilient member such as a resilient solid or material, spring, gas charged device, or the like. In an embodiment a coil spring 989 encircles the moving conductor 906 and is located between the waveguide 910 and the body first end 908.

The nose 913 carries the moving conductor 906 in a nose cavity 981. In some embodiments the nose includes a nose internal cap 983 on which a spring such as the coil spring 989 bears.

A disconnect switch includes the stationary conductor 904 and the moving conductor 906. In various embodiments, the stationary conductor is electrically isolated from the connector body 902 via an insulating member(s) such as an adjacent or supporting and/or substantially annular insulator 945, 946. In some embodiments, the insulating member provides a cavity 948 holding the stationary conductor.

The stationary conductor 904 includes a link portion 934 that extends to a contact such as a socket 943 for receiving a mating center conductor via an insulator 944 passage or entryway 947. The moving conductor 906 includes a socket 936 near the first body end 908. The socket 936 is accessible via a nose central passage or entryway 914 seen in an outer face 978 of the nose.

A stationary conductor contact such as a socket 941 adjoining the link 934 is adjacent to a moving conductor contact such as a pin 926 and these contacts selectively mate or inter-engage according to positioning of the nose 913 which operates the disconnect switch.

An exemplary waveguide 910 is electrically coupled to the body 902 and/or to a similar electromagnetic shield either within or without the body. First 919 and second 921 body chambers are located to either side of the waveguide.

As shown, the waveguide 910 is located within the body 902. The moving and stationary conductors 906, 904 are located substantially to either side of the waveguide such that depressing the nose 913 advances the moving conductor contact 926 through the waveguide aperture 987.

In various embodiments, the connector conductors 904, 906 include or are made from metal(s) or metal alloy(s) such as copper and copper alloys. In various embodiments, the connector body 902 (or a sleeve encircling the body, not shown) includes or is made from metal(s) or metal alloy(s). In various embodiments, the waveguide 910 includes or is made from metal(s) or metal alloy(s).

In some embodiments, the nose 913 provides an electromagnetic shield, for example via inclusion of metal(s) or metal alloy(s). Exemplary electromagnetic shields include a nose metal cap, coating, or layer covering an exterior of the nose, metal in a nose matrix material such as plastic, a metallic nose insulated from the integral moving conductor, and the like.

As skilled artisans will recognize, when the connector nose 913 is not depressed 900A, the waveguide attenuages signal flow via RF free space transmission between the moving and stationary conductors 906, 904 and the disconnect switch attenuates or stops signal flow via conduction between the moving and stationary conductors. In various embodiments, waveguide performance may be enhanced by positioning a conductor contact 926, 924 within the aperture when the connector nose 913 is fully extended. For example, the moving conductor contact 926 may be so positioned (as shown). Such positioning may enhance grounding of stray signals. And, in various embodiments waveguide performance may be enhanced by positioning a conductor contact 926, 924 to one side of the aperture when the connector nose 913 is fully extended. For example, the stationary conductor may be so positioned. Such positioning may enhance grounding of stray signals. In an embodiment, the moving contact 926 is positioned within the aperture and the stationary contact 924 is positioned to one side of the aperture. And, in an embodiment, the waveguide is located between the stationary and moving contacts.

Figure 10A:
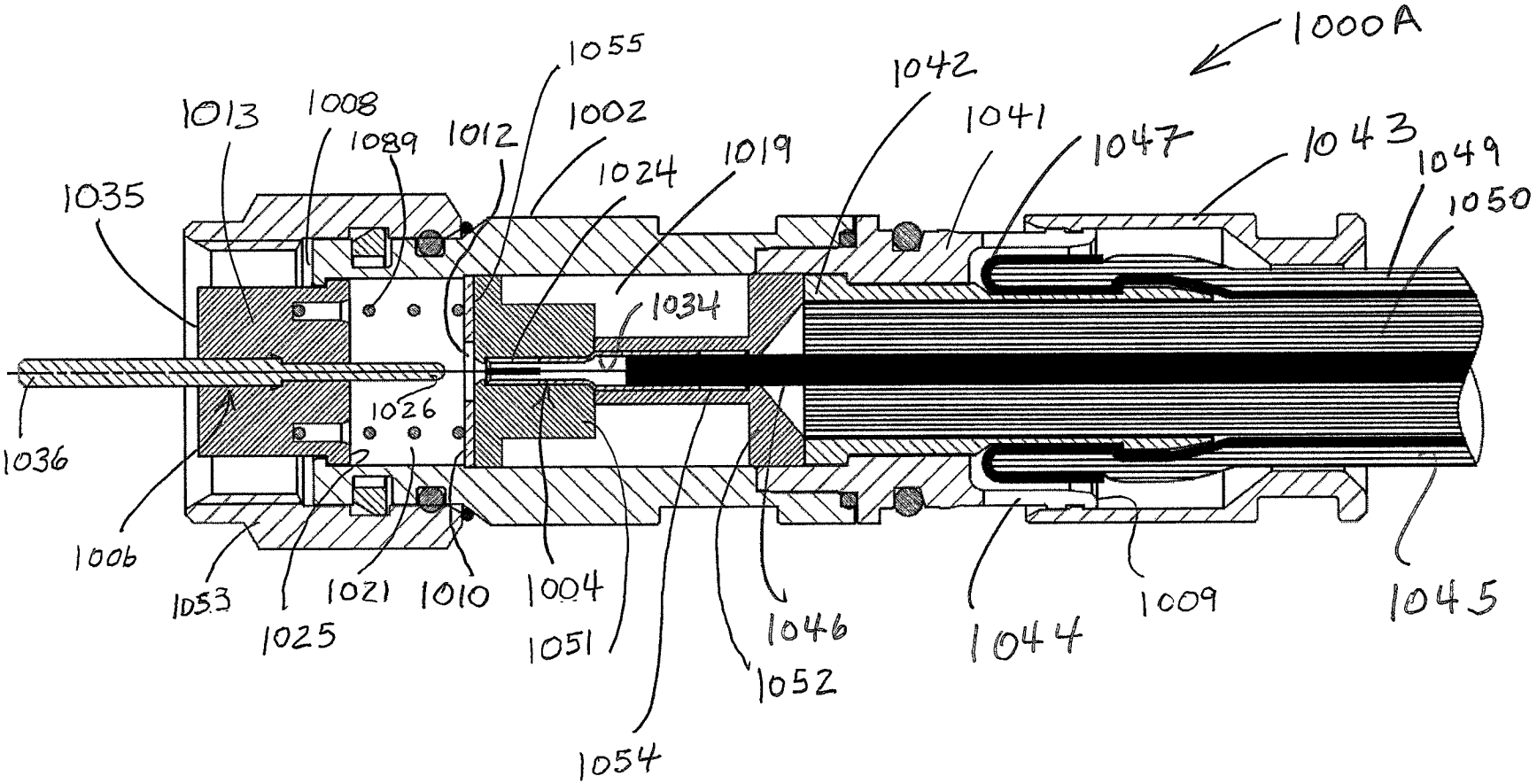
FIGS. 10A-B show a third coaxial connector with both a waveguide and a disconnect switch.
Figure 10B:
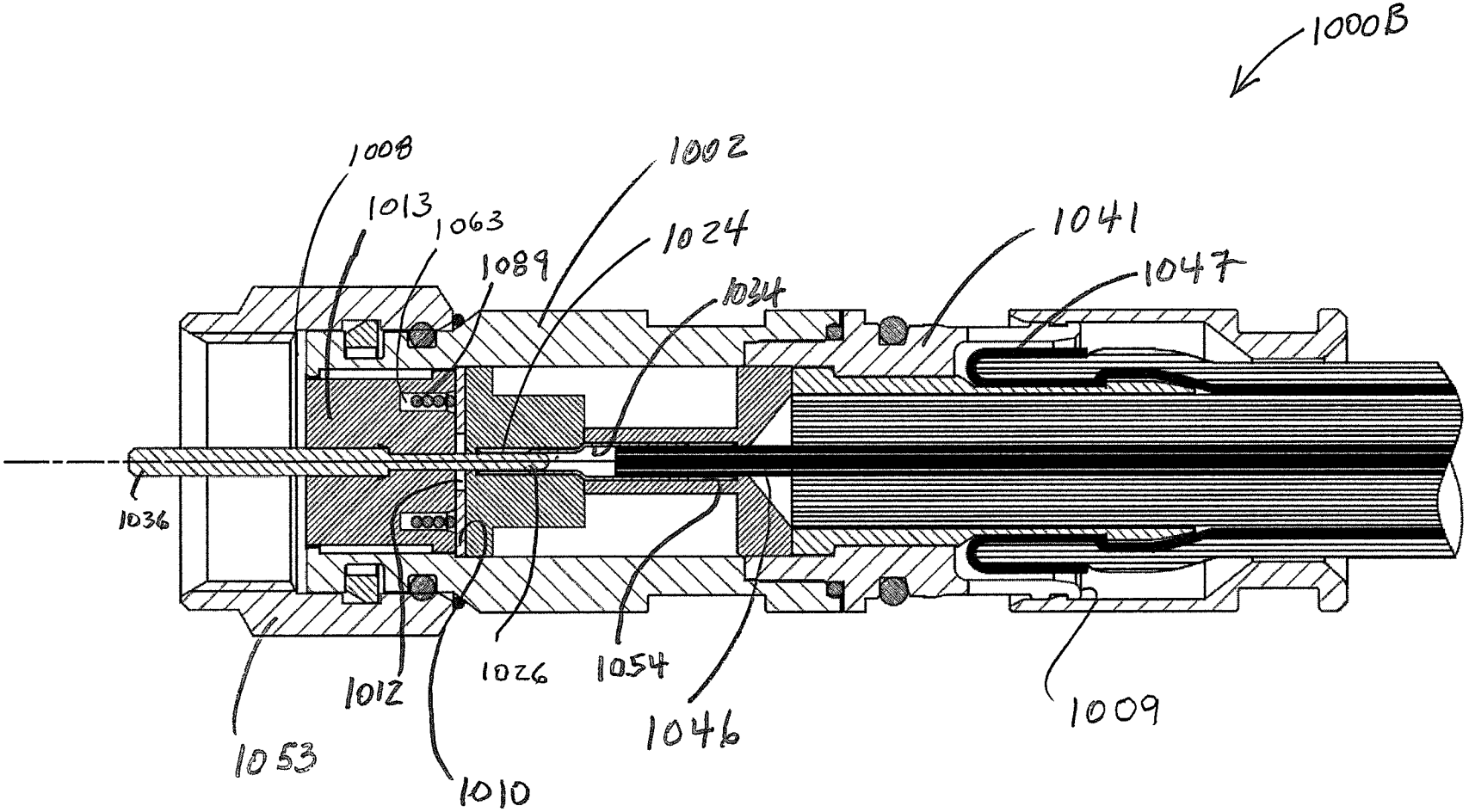

FIGS. 10A-B show cross sections of a third coaxial connector with combined shielding including a disconnect switch and a waveguide.

FIG. 10A shows a male coaxial connector with an extended nose 1000A. FIG. 10B shows connector with the nose depressed 1000B. The connector includes a body 1002, a stationary conductor 1004, a moving conductor 1006, and a waveguide 1010. In various embodiments each of these parts is a conductor of electricity.

The connector body 1002 extends from a first end such as a male connector mating end or fastener end 1008 to a second end such as a coaxial cable entry end 1009. In various embodiments the connector body includes one or more of a fastener rotatable with respect to the body 1053, a separate trailing body portion 1041, and an outer sleeve 1043.

A nose 1013 that carries the moving conductor 1006 is urged by a force such as a spring force to protrude from the first end 1008 of the body. The fully protruding nose 1013 may be contained within a fastener 1053. In various embodiments, the force may be provided by a resilient member such as a resilient solid or material, spring, gas charged device, or the like. In some embodiments a coil spring 1089 encircles the moving conductor 1006 and is located between the waveguide 1010 and the body first end 1008. And, in some embodiments, end(s) of the spring bear on one or both of the nose and the waveguide.

A disconnect switch includes a centrally located stationary conductor 1004 and the centrally located moving conductor 1006 carried by the nose 1013. The stationary conductor extends from a nose directed end 1024 toward a second body directed end 1034. The moving conductor has opposed outward and inward ends 1036, 1026 protruding from opposed outward and inward sides 1035, 1025 of the nose.

In various embodiments, the stationary conductor is electrically isolated from the connector body 1002 via an insulating member(s) such as an insulating member(s) that extends between the stationary conductor and the body. Exemplary insulating members include annular, adjacent, and supporting structures. In an embodiment, a substantially annular insulator 1051, 1052 is provided. And, in an embodiment, the insulating member provides a cavity 1054 holding the stationary conductor.

The stationary conductor nose directed end 1024 provides a contact such as a socket and the moving conductor inward end provides a mating contact such as a pin 1026. These contacts selectively mate according to positioning of the nose 1013 which operates the disconnect switch. As seen, as the nose 1013 is depressed, the spring 1089 is compressed and the disconnect switch is closed. In some embodiments, the nose includes an annular pocket 1063 that fully contains the spring 1089 when the nose is fully depressed.

A waveguide 1010 is electrically coupled to the body 1002. The waveguide is located within the body 1002 and divides first 1019 and second 1021 body chambers. The moving and stationary conductors are located substantially to either side of the waveguide such that depressing the nose advances the moving conductor contact 1026 through the waveguide aperture 1012. In an embodiment, the waveguide bears on a nose directed end 1055 of the insulator 1051.

The trailing portion of the connector body 1041 may provide means for attaching a coaxial cable 1045. Here, a post 1042 is fitted within the trailing body portion and an outer sleeve 1043 is for compressing a deformable body part 1044 against the jacket 1049 of an inserted coaxial cable. In particular, the post is inserted between a cable outer conductor 1047 and a cable dielectric 1050 such that a cable trimmed end exposes a cable center conductor 1046 that is received by a socketed end 1054 of the stationary conductor 1004 that faces the coaxial cable. In various embodiments, the cable center conductor passes through a trailing portion of the stationary conductor insulator 1052 before it engages the stationary conductor.

In various embodiments, the connector conductors 1004, 1006 include or are made from metal(s) or metal alloy(s) such as copper and copper alloys. In various embodiments, the connector body 1002 (or a sleeve encircling the body, not shown) includes or is made from metal(s) or metal alloy(s). In various embodiments, the waveguide 1010 includes or is made from metal(s) or metal alloy(s).

In some embodiments, the nose provides an electromagnetic shield, for example via inclusion of metal(s) or metal alloy(s). Exemplary electromagnetic shields include a nose metal cap, coating, or layer covering an exterior of the nose, metal in a nose matrix material such as plastic, a metallic nose insulated from the integral moving conductor, and the like.

As skilled artisans will recognize, when the connector 1000A is not mated and the nose 1013 is fully extended such that the disconnect switch is open, the waveguide attenuages signal flow via RF free space transmission between the moving and stationary conductors 1006, 1004 and the disconnect switch stops signal flow via conduction between the moving and stationary conductors. In various embodiments, waveguide performance may be enhanced by positioning a conductor contact 1026, 1024 within the aperture 1012 when the connector nose 1013 is fully extended. For example, the moving conductor contact 1026 may be so positioned. Such positioning may enhance grounding of stray signals. And, in various embodiments waveguide performance may be enhanced by positioning a conductor contact 1026, 1024 to one side of the aperture when the connector nose 1013 is fully extended. For example, the stationary conductor may be so positioned. Such positioning may enhance grounding of stray signals. In an embodiment, the moving contact 1026 is positioned within the aperture and the stationary contact 1024 is positioned to one side of the aperture. And, in an embodiment, the waveguide is located between the stationary and moving contacts.

Figure 11A:
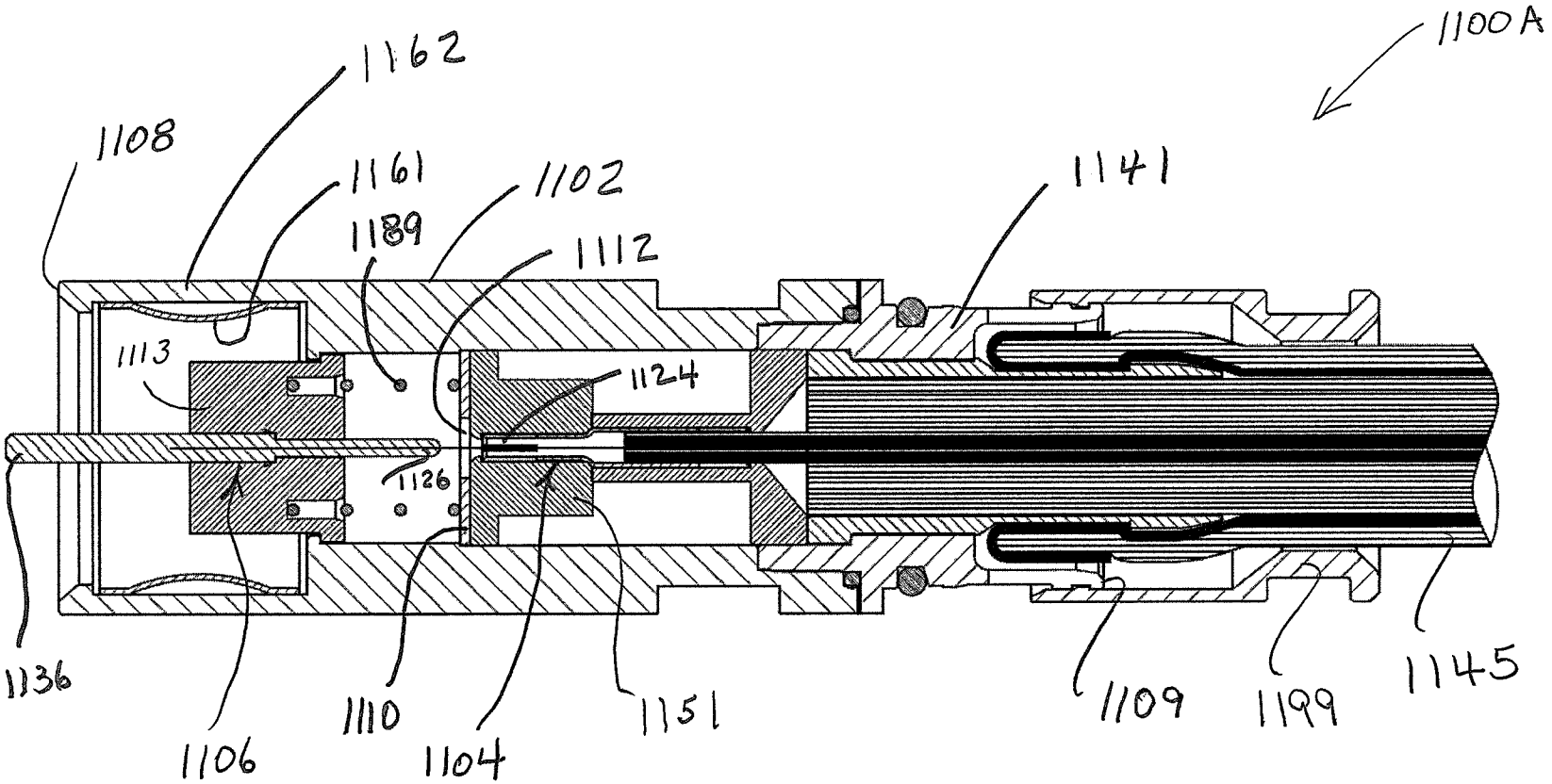
FIGS. 11A-B show a fourth coaxial connector with both a waveguide and a disconnect switch.
Figure 11B:
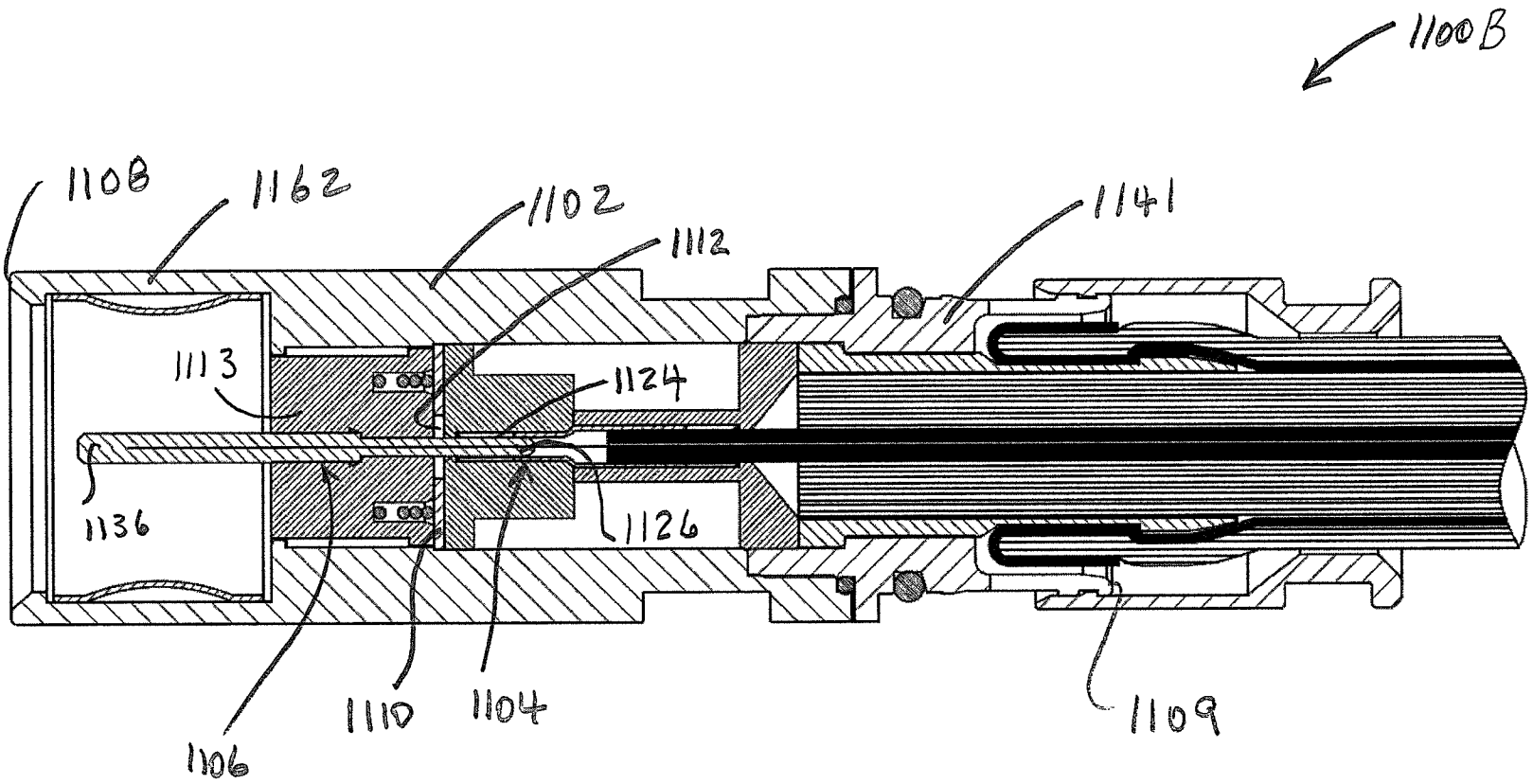

FIGS. 11A-B show cross sections of a fourth coaxial connector with combined shielding including a disconnect switch and a waveguide. The connector shown in FIGS. 11A-B differ from those shown in FIGS. 10A-B primarily due to inclusion of a non-rotating fastener portion 1162.

FIG. 11A shows a male coaxial connector with an extended nose 1100A. FIG. 11B shows the connector with the nose depressed 1100B. The connector includes a body 1102, a stationary conductor 1104, a moving conductor 1106, and a waveguide 1110.

The connector body 1102 extends from a first end such as a male connector mating end or fastener end 1108 to a second end such as a coaxial cable 1145 entry end 1109. In various embodiments the connector body includes one or more of a) a forward body portion such as a fastener end 1162 that includes a grasping means such as a resilient bail 1161 for grasping a mating female connector, b) a separate trailing body portion 1141, and c) an outer compression sleeve 1199.

Within the body 1102 a disconnect switch incorporates the moving conductor and the stationary conductor. The moving conductor 1106 carried by a spring 1189 urged nose 1113. A moving conductor outward end 1136 is for engaging a socket of a mating female connector. The stationary conductor 1104 is supported by an insulator 1151. Adjacent contacts 1126, 1124 of the moving and stationary contacts mate when the nose 1113 is depressed. Also within the body is the waveguide 1110 with a central aperture 1112 for receiving a conductor.

As skilled artisans will recognize, when the connector 1100A is not mated and the nose 1113 is fully extended such that the disconnect switch is open, the waveguide attenuages signal flow via RF free space transmission between the moving and stationary conductors 1106, 1104 and the disconnect switch stops signal flow via conduction between the moving and stationary conductors. In various embodiments, waveguide performance may be enhanced by positioning a conductor contact 1126, 1124 within the waveguide aperture 1112 when the connector nose 1113 is fully extended. For example, the moving conductor contact 1126 may be so positioned. Such positioning may enhance grounding of stray signals. And, in various embodiments waveguide performance may be enhanced by positioning a conductor contact 1126, 1124 to one side of the aperture when the connector nose 1113 is fully extended. For example, the stationary conductor may be so positioned. Such positioning may enhance grounding of stray signals. In an embodiment, the moving contact 1126 is positioned within the aperture and the stationary contact 1124 is positioned to one side of the aperture. And, in an embodiment, the waveguide is located between the stationary and moving contacts.

Figure 12A:
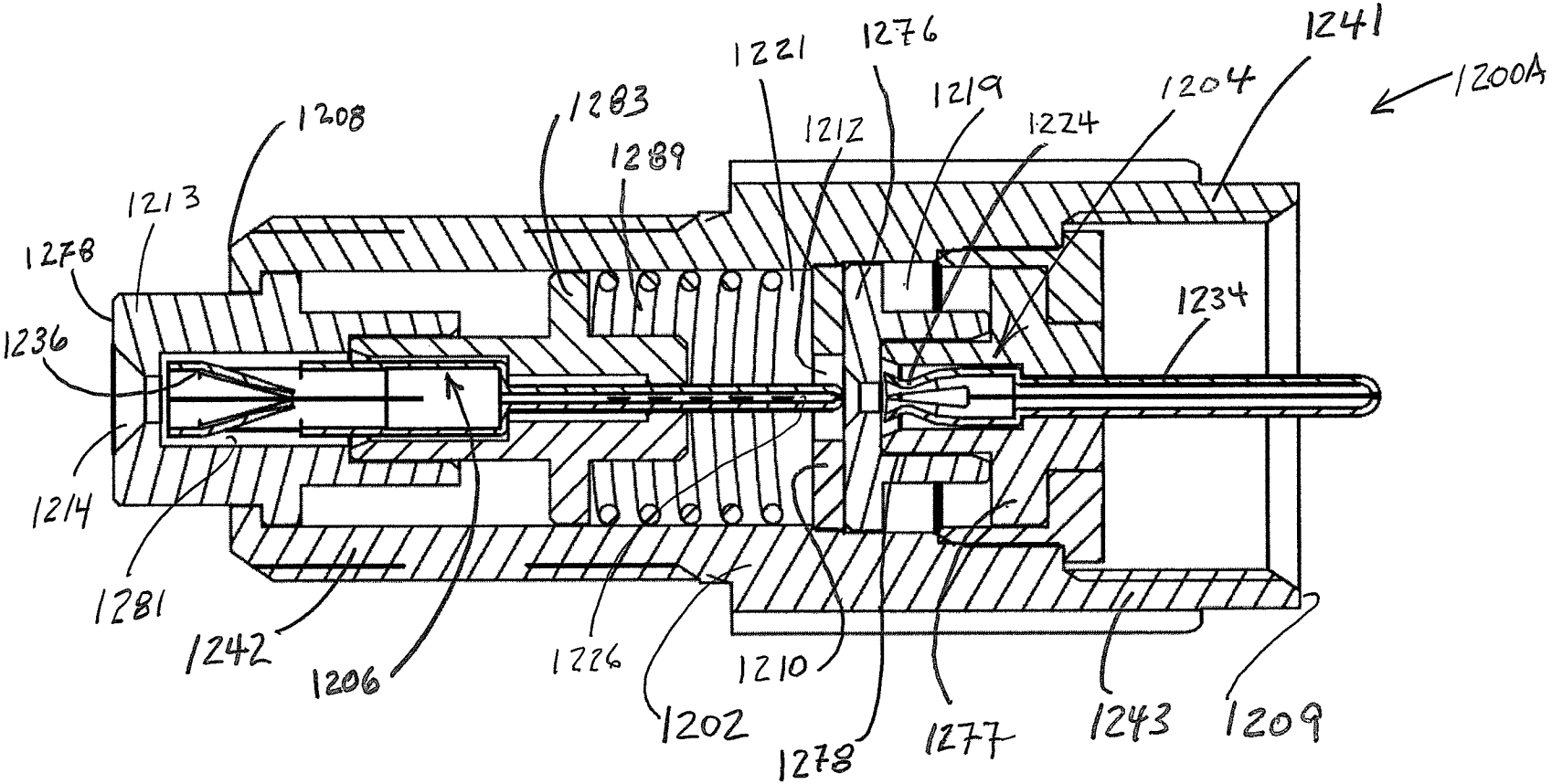
FIGS. 12A-B show a fifth coaxial connector with both a waveguide and a disconnect switch.
Figure 12B:
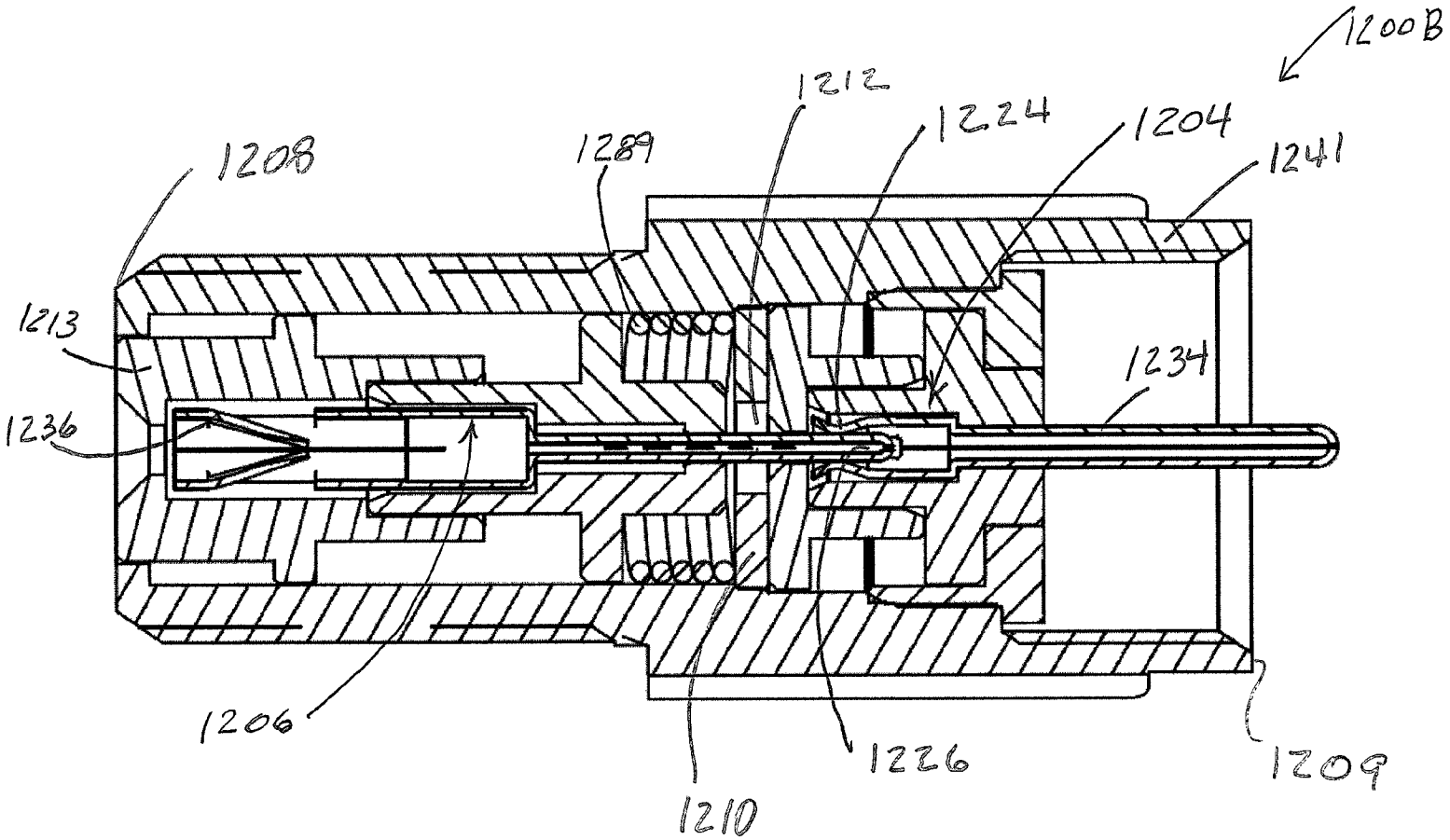

FIGS. 12A-B show cross sections of a sixth coaxial connector with combined shielding including a disconnect switch and a waveguide.

FIG. 12A shows a male to female double ended coaxial connector or adapter having an extended female end nose 1200A. FIG. 12B shows a male to female coaxial connector or adapter having a depressed female end nose 1200B. The connector includes a body 1202, a stationary conductor 1204, a moving conductor 1206, and a waveguide 1210. In various embodiments each of these parts is a conductor of electricity.

The connector 1200A also includes insulating part(s) that isolate the stationary 1204 and moving 1206 conductors from the body 1202. For example, a nose 1213 or portions of the nose may be electrical insulators.

The connector body 1202 has a first end 1208 at a female port 1242 and a second end 1209 at a male connection 1243. The nose 1213 is urged by a force to protrude from the first end 1208 of the body. In various embodiments, the force may be provided by a resilient member such as a resilient solid or material, spring, gas charged device, or the like. In an embodiment a coil spring 1289 encircles the moving conductor 1206 and is located between the waveguide 1210 and the body first end 1208.

The nose 1213 carries the moving conductor 1206 in a nose cavity 1281. In some embodiments the nose includes a nose internal cap 1283 on which a spring such as the coil spring 1289 bears.

A disconnect switch includes the stationary conductor 1204 and the moving conductor 1206. In various embodiments, the stationary conductor is electrically isolated from the connector body 1202 via a unitary or separable part insulating member such as an adjacent or supporting and/or substantially annular insulator 1276, 1277. Some embodiments provide an insulator cavity 1278 for holding the stationary conductor.

The stationary conductor 1204 includes a terminal or center pin portion 1234 that is in the form of a center pin extending from a fastener 1241 near the connector second or male end 1209. The moving conductor 1206 includes a socket 1236 near the first body end 1208. The socket 1236 is for receiving a mating coaxial connector center pin and is accessible via a nose central passage or entryway 1214 seen in an outer face 1278 of the nose.

A stationary conductor contact such as a socket 1224 adjoining the terminal 1234 is adjacent to a moving conductor contact such as a pin 1226 and these contacts selectively mate according to positioning of the nose 1213 relative to the body which operates the disconnect switch. As seen, as the nose 1213 is depressed, the spring 1289 is compressed.

An exemplary waveguide 1210 is electrically coupled to the body 1202 and/or to a similar electromagnetic shield either within or without the body. As shown, the waveguide 1210 is located within the body 1202 and divides first 1219 and second 1221 body chambers. Here and elsewhere in this specification, a waveguide dividing a connector body into separate chambers similar to these may be referred to as a midbody waveguide. The moving and stationary conductors 1206, 1204 are located substantially to either side of the waveguide such that depressing the nose 1213 advances the moving conductor contact 1226 through the waveguide aperture 1212.

In various embodiments, the connector conductors 1204, 1206 include or are made from metal(s) or metal alloy(s) such as copper and copper alloys. In various embodiments, the connector body 1202 (or a sleeve encircling the body, not shown) includes or is made from metal(s) or metal alloy(s). In various embodiments, the waveguide 1210 includes or is made from metal(s) or metal alloy(s).

In some embodiments, the nose 1213 provides an electromagnetic shield, for example via inclusion of metal(s) or metal alloy(s). Exemplary electromagnetic shields include a nose metal cap, coating, or layer covering an exterior of the nose, metal in a nose matrix material such as plastic, a metallic nose insulated from the integral moving conductor, and the like.

As skilled artisans will recognize, when the connector 1200A is not mated, the waveguide attenuages signal flow via RF free space transmission between the moving and stationary conductors 1206, 1204 and the disconnect switch attenuates or stops signal flow via conduction between the moving and stationary conductors. In various embodiments, waveguide performance may be enhanced by positioning a conductor contact 1226, 1224 within the aperture when the connector nose 1213 is fully extended. For example, the moving conductor contact 1226 may be so positioned (as shown). Such positioning may enhance grounding of stray signals. And, in various embodiments waveguide performance may be enhanced by positioning a conductor contact 1226, 1224 to one side of the aperture when the connector nose 1213 is fully extended. For example, the stationary conductor may be so positioned. Such positioning may enhance grounding of stray signals. In an embodiment, the moving contact 1226 is positioned within the aperture and the stationary contact 1224 is positioned to one side of the aperture. And, in an embodiment, the waveguide is located between the stationary and moving contacts.

Figure 13A:
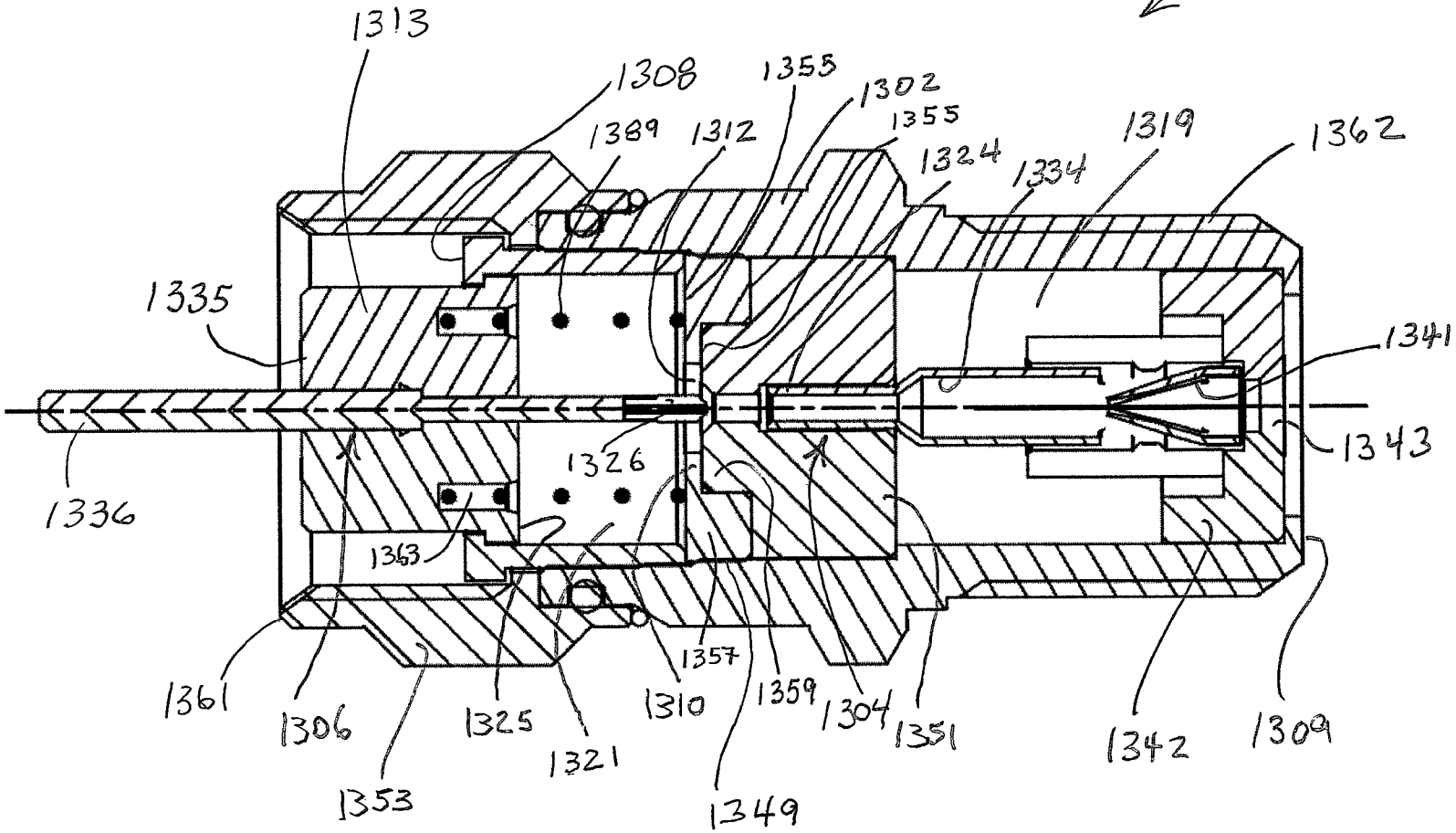
FIGS. 13A-B show a sixth coaxial connector with both a waveguide and a disconnect switch.
Figure 13B:
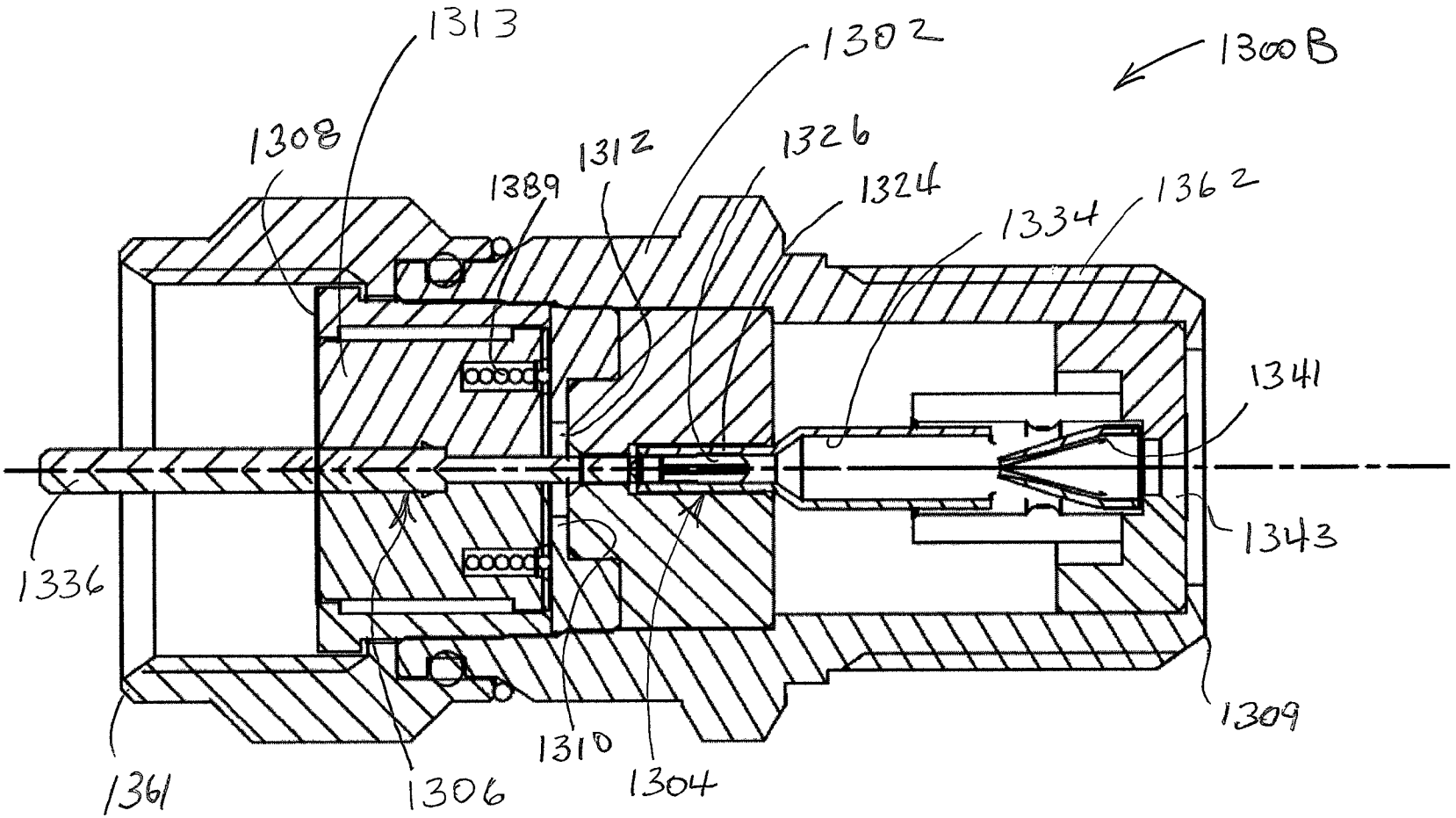

FIGS. 13A-B show cross sections of a seventh coaxial connector with combined shielding including a disconnect switch and a waveguide.

FIG. 13A shows a male to female double ended coaxial connector or adapter having an extended male end nose 1300A. FIG. 13B shows a male to female coaxial connector or adapter having a depressed male end nose 1300B. The connector includes a body 1302, a stationary conductor 1304, a moving conductor 1306, and a waveguide 1310. In various embodiments each of these parts is a conductor of electricity.

The connector body 1302 extends from a first end such as a male connector mating end or fastener end 1308 to a second female connector end 1309. In various embodiments the connector includes a male end fastener such as a fastener that is rotatable with respect to the body 1353.

A nose 1313 that carries the moving conductor 1306 is urged by a force such as a spring force to protrude from the first end 1308 of the body. As shown here and elsewhere in this specification the fully protruding nose 1313 may be fully contained within a fastener 1353. In various embodiments, the force may be provided by a resilient member such as a resilient solid or material, spring, gas charged device, or the like. In some embodiments a coil spring 1389 encircles the moving conductor 1306 and is located between the waveguide 1310 and the body first end 1308. And, in some embodiments, end(s) of the spring bear on one or both of the nose and the waveguide.

A disconnect switch includes a centrally located stationary conductor 1304 and the centrally located moving conductor 1306 carried by the nose 1313. The stationary conductor extends via a link 1334 from a nose directed end 1324 toward the body second end 1309. The moving conductor has opposed outward and inward ends 1336, 1326 protruding from opposed outward and inward sides 1335, 1325 of the nose.

In various embodiments, the stationary conductor 1304 is electrically isolated from the connector body 1302 via an insulating member(s) such as an insulating member(s) that extends between the stationary conductor and the body. Exemplary insulating members include annular, adjacent, and supporting structures. In an embodiment, a substantially annular insulator 1351 is provided. As shown, the insulator 1351 may be supported by the connector body 1302.

The stationary conductor nose directed end 1324 provides a contact such as a socket and the moving conductor inward end provides a mating contact such as a pin 1326. These contacts selectively mate according to positioning of the nose 1313 which operates the disconnect switch. As seen, as the nose 1313 is depressed, the spring 1389 is compressed and the disconnect switch is closed. In some embodiments, the nose includes an annular pocket 1363 that may fully contain the spring 1389 when the nose is fully depressed.

A waveguide 1310 is electrically coupled to the body 1302, for example by fitment to the body inside wall 1349. The waveguide may have shoulders or a bore 1357 for fitment about a knob 1359 of the insulator 1351.

The waveguide is located within the body 1302 and divides first 1319 and second 1321 body chambers. The moving and stationary conductors 1304, 1306 are located substantially to either side of the waveguide such that depressing the nose advances the moving conductor contact 1326 through the waveguide aperture 1312. In an embodiment, the waveguide bears on a nose directed end 1355 of the insulator 1351.

Opposite the male fastener end of the connector 1361 is a female end of the connector such as an externally threaded end 1362. A female end insulator 1342 supported by the connector body 1302 receives a socket 1341 of the stationary conductor 1304. The socket is interconnected with the stationary conductor contact 1324 via a link 1334. A passage or entryway in the female end insulator 1343 provides access to the socket.

In various embodiments, the connector conductors 1304, 1306 include or are made from metal(s) or metal alloy(s) such as copper and copper alloys. In various embodiments, the connector body 1302 (or a sleeve encircling the body, not shown) includes or is made from metal(s) or metal alloy(s). In various embodiments, the waveguide 1310 includes or is made from metal(s) or metal alloy(s).

In some embodiments, the nose provides an electromagnetic shield, for example via inclusion of metal(s) or metal alloy(s). Exemplary electromagnetic shields include a nose metal cap, coating, or layer covering an exterior of the nose, metal in a nose matrix material such as plastic, a metallic nose insulated from the integral moving conductor, and the like.

As skilled artisans will recognize, when the connector 1300A is not mated and the nose 1313 is fully extended such that the disconnect switch is open, the waveguide attenuages signal flow via RF free space transmission between the moving and stationary conductors 1306, 1304 and the disconnect switch stops signal flow via conduction between the moving and stationary conductors. In various embodiments, waveguide performance may be enhanced by positioning a conductor contact 1326, 1324 within the aperture 1312 when the connector nose 1313 is fully extended. For example, the moving conductor contact 1326 may be so positioned. Such positioning may enhance grounding of stray signals. And, in various embodiments waveguide performance may be enhanced by positioning a conductor contact 1326, 1324 to one side of the aperture when the connector nose 1313 is fully extended. For example, the stationary conductor may be so positioned. Such positioning may enhance grounding of stray signals. In an embodiment, the moving contact 1326 is positioned within the aperture and the stationary contact 1324 is positioned to one side of the aperture. And, in an embodiment, the waveguide is located between the stationary and moving contacts.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A shielded coaxial connector for use in cable and satellite television signal distribution systems, the connector comprising:

a hollow metallic body;

within the body, a midbody waveguide;

a stationary center conductor and a moveable center conductor, the center conductors operable as a single pole, single throw disconnect switch via movement of one of the center conductors through an aperture in the waveguide; and, the waveguide aperture having a maximum dimension not exceeding 3.0 mm;

wherein the disconnect switch and the waveguide interoperate to shield the stationary center conductor from stray radio frequency signals when the disconnect switch is open and wherein the disconnect switch enables conduction of radio frequency signals through the connector when the disconnect switch is closed.

2. The shielded coaxial connector of claim 1 wherein the waveguide aperture is substantially in the form of a circular aperture.

3. The shielded coaxial connector of claim 1 wherein a waveguide thickness normal to an aperture centerline is in the range of 0.5 to 1.5 mm.

4. The shielded coaxial connector of claim 1 further comprising:

an actuator that carries the moving conductor is urged by a spring to protrude from an end of the body.

5. The shielded coaxial connector of claim 4 wherein the spring encircles the moving center conductor.

6. The shielded coaxial connector of claim 5 wherein the spring is located between the waveguide and a surface of the actuator for engaging a mating coaxial connector.

7. The shielded coaxial connector of claim 5 further comprising:

an actuator surface and a waveguide surface defining end points of a line of variable length;

a minimum line length indicative of the disconnect switch in a closed state for conducting a signal through the connector; and, a maximum line length indicative of the disconnect switch in an open state for preventing conduction of a signal through the connector.

8. The shielded coaxial connector of claim 5 wherein when the disconnect switch is open, a tip of the movable center conductor is located within the waveguide aperture.

9. The shielded coaxial connector of claim 8 wherein the stationary conductor is not located within the waveguide aperture.

10. The shielded coaxial connector of claim 5 wherein the disconnect switch includes a socket and a mating pin wherein interengagement of the socket and the pin closes the disconnect switch.

11. The shielded coaxial connector of claim 10 further comprising:

a first coaxial port for engaging a male coaxial connector;

the moving conductor forming a part of the first coaxial port; and, the actuator forming at least part of a first port insulator for electrically isolating the moving conductor from the body.

12. The shielded coaxial connector of claim 11 further comprising:

a second coaxial port for engaging a male coaxial connector;

the stationary conductor forming a part of the second coaxial port; and, a second port insulator for electrically isolating the stationary conductor from the body.

13. The shielded coaxial connector of claim 12 further comprising:

a male coaxial connection for engaging a female coaxial connector;

the stationary conductor forming a part of the male coaxial connection; and, a male coaxial connection insulator for electrically isolating the stationary conductor from the body.

14. The shielded coaxial connector of claim 6 further comprising:

a male coaxial connection for engaging a female coaxial connector;

the moving conductor forming a part of the male coaxial connection;

the actuator protruding into a fastener of the male coaxial connection; and, the actuator forming at least part of a male coaxial connection insulator for electrically isolating the moving conductor from the body.

15. The shielded coaxial connector of claim 14 further comprising:

a coaxial port for engaging with a male coaxial connector;

the stationary conductor forming a part of the coaxial port; and, a coaxial port insulator for electrically isolating the stationary conductor from the body.

16. A method of protecting a CATV coaxial connector center conductor from ingress of radio frequency signals, the method comprising the steps of:

providing a coaxial connector;

along a longitudinal centerline of the connector, locating a stationary center conductor and a movable center conductor;

in a first configuration, shielding the stationary conductor from radio frequency signals with a waveguide when the stationary conductor does not contact the moving conductor; and, in a second configuration, interengaging the movable and stationary conductors via movement of the movable conductor in an aperture of the waveguide to provide signal transmission through the connector;

wherein a spring urges the first configuration and a mating coaxial connector that compresses the spring forces the second configuration.

17. The method of claim 16 wherein a tip of the stationary conductor is located in a waveguide aperture.

18. The method of claim 16 wherein a waveguide aperture is located such that the stationary conductor does not pass through the aperture.

* * * * *